US011306538B2

(12) United States Patent
Välisalo

(10) Patent No.: US 11,306,538 B2
(45) Date of Patent: Apr. 19, 2022

(54) FLUID OPERATED DRILLING DEVICE AND A METHOD FOR DRILLING A HOLE USING A FLUID OPERATED DRILLING DEVICE

(71) Applicant: PIRKAN LAATUPALVELU OY, Pirkkala (FI)

(72) Inventor: Juhani Välisalo, Pirkkala (FI)

(73) Assignee: PIRKAN LAATUPALVELU OY, Pirkkala (FI)

( * ) Notice: Subject to any disclaimer, the term of this patent is extended or adjusted under 35 U.S.C. 154(b) by 45 days.

(21) Appl. No.: 16/642,587

(22) PCT Filed: Aug. 30, 2018

(86) PCT No.: PCT/FI2018/050613

§ 371 (c)(1),
(2) Date: Feb. 27, 2020

(87) PCT Pub. No.: WO2019/043295

PCT Pub. Date: Mar. 7, 2019

(65) Prior Publication Data

US 2020/0347678 A1 Nov. 5, 2020

(30) Foreign Application Priority Data

Aug. 31, 2017 (FI) ..... 20175778

(51) Int. Cl.
*E21B 4/14* (2006.01)
*E21B 10/36* (2006.01)
(Continued)

(52) U.S. Cl.
CPC ..... *E21B 4/14* (2013.01); *E21B 10/36* (2013.01); *E21B 4/20* (2013.01); *E21B 21/12* (2013.01)

(58) Field of Classification Search
CPC ..... E21B 4/14; E21B 4/20; E21B 1/00; E21B 1/02; E21B 1/12; E21B 1/14; E21B 1/24; E21B 1/38
See application file for complete search history.

(56) References Cited

U.S. PATENT DOCUMENTS 2,673,713 A * 3/1954 Ringler ..... E21B 4/14 175/106
3,095,046 A 6/1963 Mori
(Continued)

FOREIGN PATENT DOCUMENTS

AU 688311 B2 3/1998
CA 959480 A 12/1974
(Continued)

OTHER PUBLICATIONS

Finnish Search Report in related Finnish Patent Application No. 20175778, dated Mar. 28, 2018, 1 page.
(Continued)

*Primary Examiner* — Jennifer H Gay
(74) *Attorney, Agent, or Firm* — FisherBroyles, LLP; Robert Kinberg

(57) ABSTRACT

A fluid operated drilling device for drilling a hole said device having a hammer, a rotation device and a drill rod. The hammer includes a tubular main body, a back head, a cylindrical piston housing, a reciprocating piston, a space, a valve unit and a fluid pressure supply unit. A hollow portion of the piston is open to lead pressurized operating fluid directly to the hollow portion from the fluid pressure supply passage. The hammer includes an axial exhaust passage formed between the main body and the piston housing. The valve unit includes a valve exhaust passage and the piston has a lower part and an upper part detachably connected to
(Continued)

each other. The invention also relates to a method for drilling a hole using the fluid operated drilling device.

19 Claims, 14 Drawing Sheets

(51) Int. Cl.
*E21B 4/20* (2006.01)
*E21B 21/12* (2006.01)

(56) References Cited

U.S. PATENT DOCUMENTS 3,527,239 A * 9/1970 Boom ..... E21B 4/14 173/64
3,606,930 A * 9/1971 Curington ..... E21B 4/14 173/73
4,828,048 A * 5/1989 Mayer ..... E21B 4/14 173/208
5,803,188 A * 9/1998 McInnes ..... E21B 4/14 173/126
6,293,357 B1 * 9/2001 Patterson ..... E21B 4/14 173/13
6,994,175 B2 * 2/2006 Egerstrom ..... E21B 4/14 175/296
2002/0014354 A1 * 2/2002 Patterson ..... E21B 7/068 175/57
2004/0188146 A1 * 9/2004 Egerstrom ..... E21B 4/14 175/296
2007/0261869 A1 11/2007 In
2009/0107723 A1 * 4/2009 Kusko ..... E21B 41/0085 175/25
2011/0209919 A1 * 9/2011 Aros ..... E21B 10/38 175/296
2012/0006598 A1 * 1/2012 Lyon ..... E21B 4/14 175/296
2020/0270949 A1 * 8/2020 Valisalo ..... E21B 34/06

FOREIGN PATENT DOCUMENTS

GB 675988 A * 7/1952 ..... E21B 10/38
GB 2522625 A * 8/2015 ..... E02F 9/2296
WO WO-2017164713 A1 * 9/2017 ..... E21B 4/14
WO WO-2018220098 A1 * 12/2018 ..... E21B 1/00
WO WO-2019038474 A1 * 2/2019 ..... E21B 34/06
WO WO-2019043295 A1 * 3/2019 ..... E21B 4/14

OTHER PUBLICATIONS

International Search Report in related International Patent Application No. PCT/FI2018/050613, dated Mar. 7, 2019, 5 pages.
International Written Opinion in related International Patent Application No. PCT/FI2018/050613, dated Mar. 7, 2019, 11 pages.

* cited by examiner

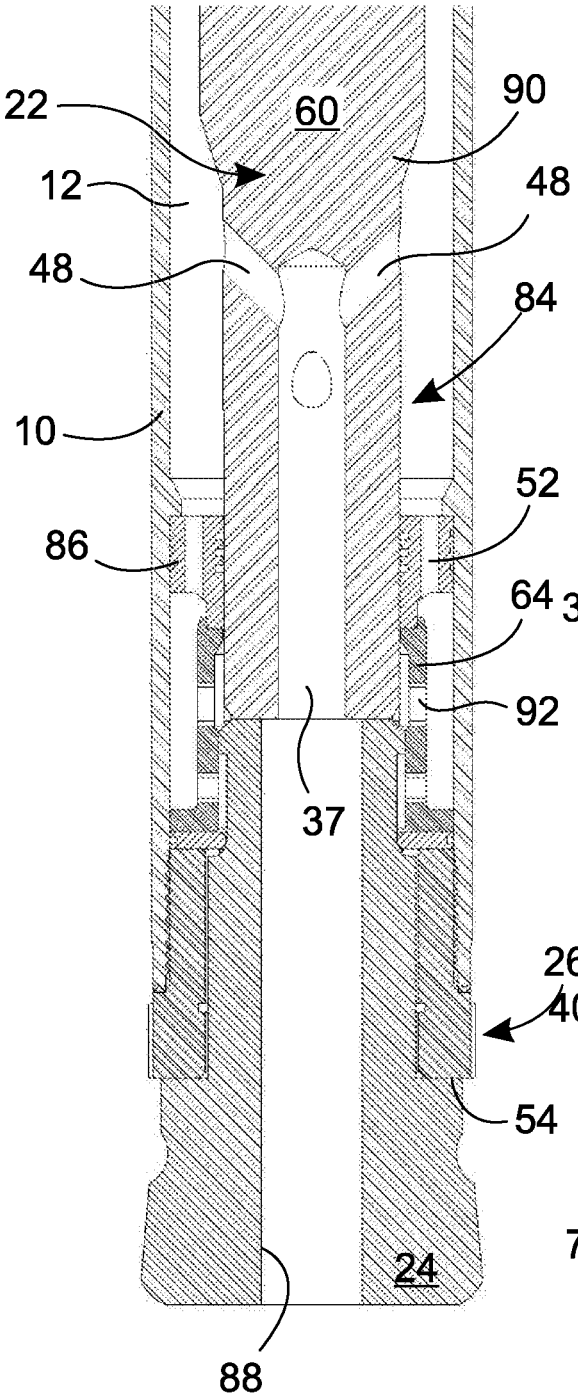
Fig 4c
Fig 4d
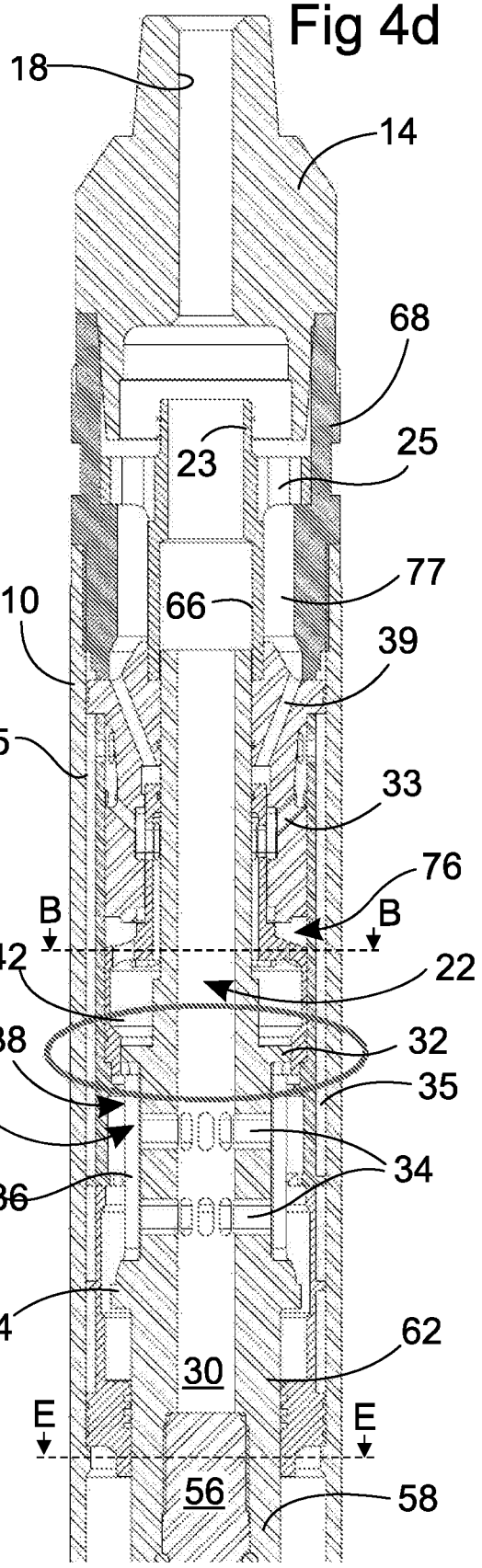

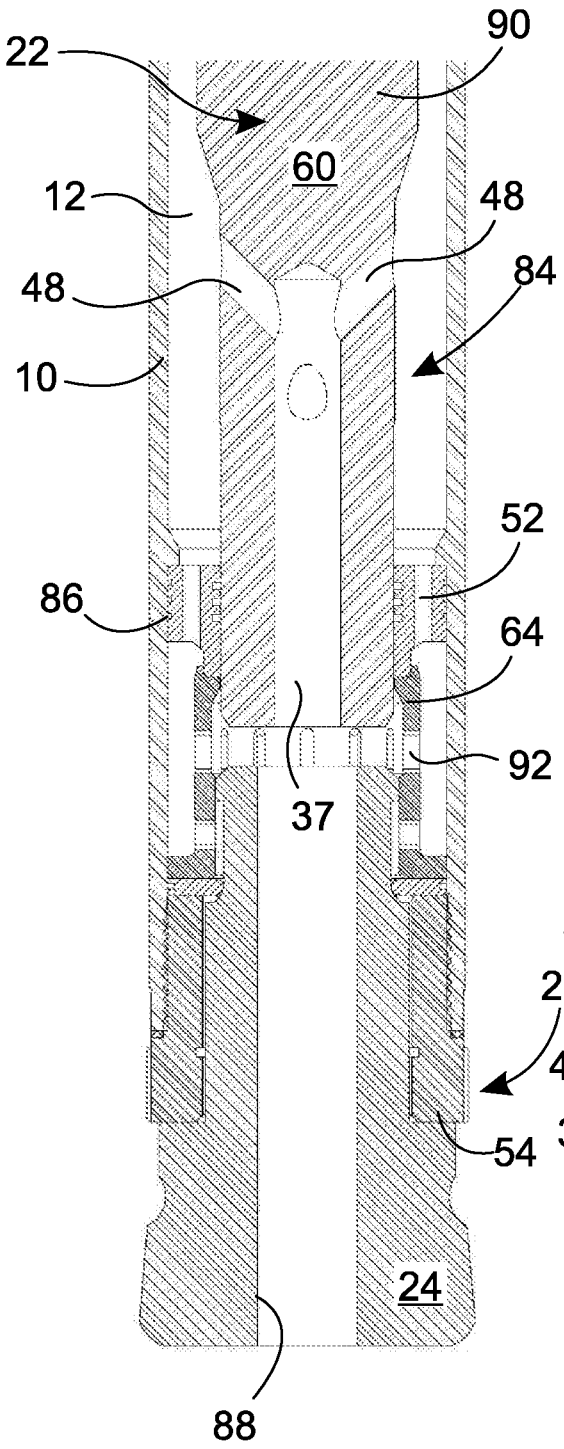
Fig 4k
Fig 4l
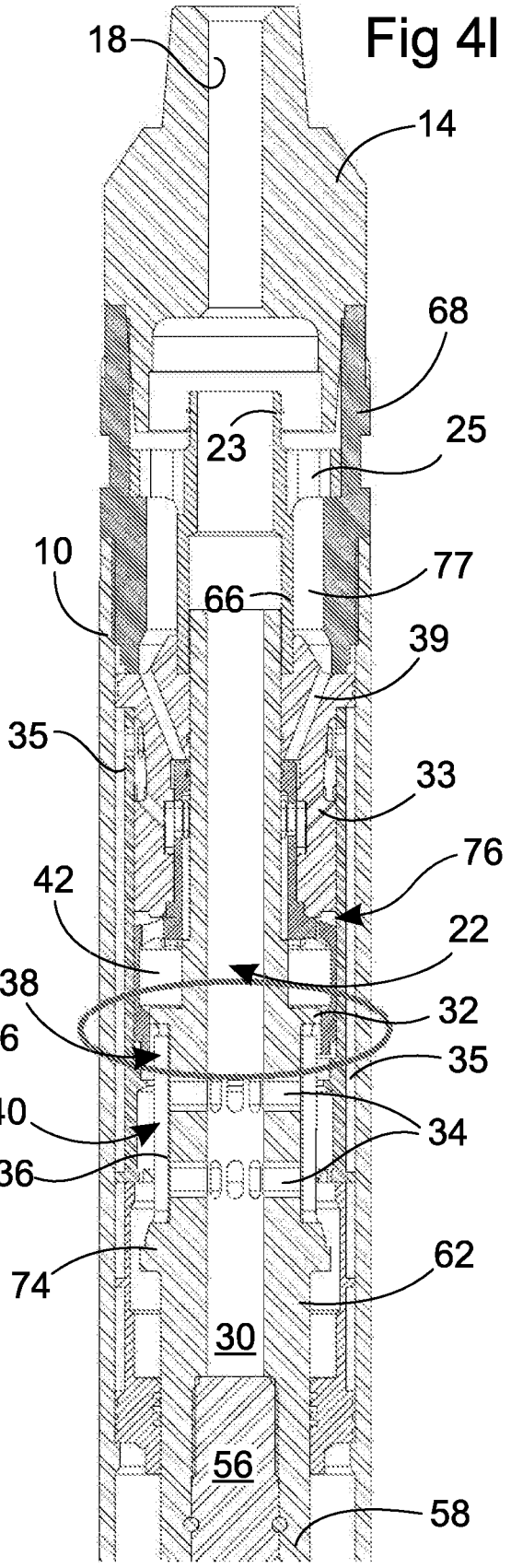

FLUID OPERATED DRILLING DEVICE AND A METHOD FOR DRILLING A HOLE USING A FLUID OPERATED DRILLING DEVICE

CROSS-REFERENCE TO RELATED APPLICATIONS

The present application is a U.S. National Stage of International Patent Application No. PCT/FI2018/050613, filed Aug. 30, 2018, which claims the benefit of Finnish Patent Application No. 20175778, filed Aug. 31, 2017.

FIELD OF THE INVENTION

The invention relates to a fluid operated drilling device for drilling a hole, drilling device having a hammer for creating the hole with a rotating and percussive motion, a rotation device for rotating the hammer and a drill rod connecting the rotation device to the hammer and transporting operating pressurized drill fluid to the hammer for creating the percussive motion of the hammer, the hammer comprising:

a tubular main body having a hollow interior;

a back head, for connecting the hammer to the drill rod, coupled to an upper end of the main body and having a fluid pressure supply passage;

a cylindrical piston housing connected to the main body;

a reciprocating piston slidably installed in the piston housing, for impacting a drill bit of a bit unit installed at a lower end of the main body, the drill bit being movable for a predetermined length longitudinally relatively to the main body, the piston having a first end and second end, the first end being closer to the drill rod, a hollow portion, a first communication hole connected to the hollow portion and an annular pressurizing portion protruding on the piston's outer circumferential surface, the hollow portion being open to lead pressurized operating fluid directly to the hollow portion of the piston from the fluid pressure supply passage;

a space between the piston and the piston housing divided by the annular pressurizing portion in a radial direction of the piston into a first space portion for elevating the piston and second space portion for striking the piston;

a valve unit for controlling fluid discharged from the second space portion, the valve unit including a valve exhaust passage for discharging fluid from the second space portion;

a fluid pressure supply unit for supplying high pressure fluid delivered to the fluid pressure supply passage of the back head to the first space portion and the second space portion; and an axial exhaust passage formed between the main body and the piston housing for discharging fluid outside the piston housing;

wherein the rotation device is rotating the bit unit using the drill rod and the main body.

The invention also relates to a method for drilling a hole using a fluid operated drilling device.

BACKGROUND OF THE INVENTION

A fluid operated percussive hammer according to the prior art is rotated by means of a drill rod for at least transporting operating pressurized drill fluid to a percussive unit for creating a percussive motion for drilling a hole in relatively hard formations or in mixture of hard and soft formations. In the hammer the same drilling fluid transports cuttings from a drill face and at least partially cleaning the drill hole. The drill rod is arranged to create a rotary motion to the percussive hammer that has a reciprocating piston which impacts a drill bit attached on the percussive hammer and said impacting drill bit being movable a certain predetermined length longitudinally relatively to the percussive hammer body. Water or drilling fluid may contain additives to increase its capacity to carry drilled waste material from the hole or assist to support the drill hole. The hammer includes a tubular main body having a hollow interior. The hammer has a back head connecting together with a drill pipe, which has at least a pressure fluid supply passage to transfer pressurized fluid to the percussive hammer. The percussive hammer has a percussive piston adapted to hit the percussive drill bit drilling the drill hole at its lower end portion.

Known water hammers such as Wassara have a valve as well as a bottom pressure chamfer lifting the piston to its elevated loading position and a top chamfer driving the piston against the percussive drill bit, such action being controlled by a valve system on the top portion of the percussive hammer.

Prior art document US 20070261869 A1 discloses a water hammer where a valve system is primarily located at the top portion of the water hammer. The water hammer has a valve member forming first, second and third space portions creating the percussive motion of the water hammer. When using such construction with pressurized operating fluid that has high viscosity, for example mud or oil, or contains solids, the pressurized fluid enters the space portions through channels. These channels have a diameter that is considerably smaller than the diameter of a fluid pressure supply passage feeding fluid. When fluid enters the smaller diameter of these channels the speed of fluid flow increases. Fluid with high viscosity or with solid content and high speed causes considerable friction against the walls of the channels and therefore has an abrasive effect on the walls. The effect is even larger with fluids containing solid particles, for example mud. The abrasive effect causes rapid wear of the internal parts of the hammer reducing its service life.

In addition, when using such construction, and especially a piston with maximum diameter, it is difficult to arrange flushing in a manner that will keep the components inside the hammer clean because there is practically no flushing inside the hollow interior of the tubular main body. Also, a large piston moves a relatively large volume of water back and forward, which reduces power, making it difficult to seal the hammer. The movement of large volumes of water back and forward also contaminates the hammer with drilled debris and fine pieces of rock and sand. This construction has a continuous hollow portion through the piston from one end of the piston to another, which hollow portion effectively guides operating fluid out of the percussive unit, making it difficult to guide fluid through the hammer to effectively lubricate other parts in the system. In addition, all foreign particles in such a system are trapped within the water hammer as the hammer rotates and have no way out except through sealed areas breaking, the seals in the process. This problem exists even when a construction in which a moveable pressure shield is fitted in the lower portion of the water hammer to better accommodate movement and the suction of the mentioned oversized piston, which also creates a suction effect and elevates the suction of foreign material of the water hammer.

SUMMARY OF THE INVENTION

An object of the invention is to develop a fluid operated drilling device and a method for drilling a hole which minimizes internal wear of the hammer when using high viscosity operating fluid. Another object of the invention is to create a fluid operated drilling device that is easier to manufacture than drilling devices according to prior art. The invention is characterized by a fluid operated drilling device for drilling a hole, the drilling device having a hammer for creating the hole with a rotating and percussive motion, a rotation device for rotating the hammer and a drill rod connecting the rotation device to the hammer and transporting operating pressurized drill fluid to the hammer for creating the percussive motion of the hammer. The hammer comprises a tubular main body having a hollow interior, a back head, for connecting the hammer to the drill rod, coupled to an upper end of the main body and having a fluid pressure supply passage and a cylindrical piston housing connected to the main body. The hammer further includes a reciprocating piston slidably installed in the piston housing, for impacting a drill bit of a bit unit installed at a lower end of the main body, the drill bit being movable for a predetermined length longitudinally relatively to the main body The piston has a first end and a second end, the first end being closer to the drill rod, a hollow portion, a first communication hole connected to the hollow portion and an annular pressurizing portion protruding on the piston's outer circumferential surface. The hollow portion of the piston is open to lead pressurized operating fluid directly to the hollow portion of the piston from the fluid pressure supply passage. In addition the hammer includes a space between the piston and the piston housing divided by the annular pressurizing portion in a radial direction of the piston into a first space portion for elevating the piston and a second space portion for striking the piston, a valve unit for controlling fluid discharged from the second space portion, the valve unit including a valve exhaust passage for discharging fluid from the second space portion, and a fluid pressure supply unit for supplying high pressure fluid delivered to the fluid pressure supply passage of the back head to the first space portion and the second space portion. The hammer further includes an axial exhaust passage formed between the main body and the piston housing for discharging fluid outside the piston housing. The rotation device rotates the bit unit using the drill rod and the main body. The piston has a lower part and an upper part detachably connected to each other.

In the invention pressurized operating fluid flow is led from the drill rod through the fluid pressure supply passage of the back head straight into the hollow portion of the piston. Therefore the pressurized operating fluid flow is not led to a channel with much smaller diameter and the speed of the flow does not increase like in prior art drilling devices. Fluid is then discharged from the second space portion through a valve exhaust passage in the valve unit and led through the axial exhaust passage outside the piston housing. Since high viscosity fluid discharged from the second space portion through valve exhaust passage and axial exhaust passage does not have an initial flow speed in the second space portion, the wear of these exhaust passages remains minor.

By making the piston from two separate parts, the parts are easier to manufacture and can be serviced separately. A single long piston would be hard to machine into correct dimensions, hard to transport and hard to service. Since the upper part of the piston includes most of the complex flow channel and valve structures, it is exposed to wear created by the operating fluid. The lower part, which is a simpler design, is less exposed to wear and can be used for a longer period of time before being replaced. By using detachable upper and lower parts, the upper part can be discarded earlier while the lower part still remains in use. In addition to the above mentioned benefit, the sealing of the piston is easier to install when the lower part, which has a larger diameter than the piston seal surrounding the upper part of the piston, can be detached from upper part during installation of the piston seal. This enables continuous circular seals to be used which have better durability.

The upper part of the piston and the lower part of the piston are consecutive in the length of the piston. This enables the piston to be made of shorted parts, thus making it easier to transport to drilling sites.

Preferably, the upper part of the piston has the hollow portion, the first communication hole and the annular pressurizing portion and the lower part of the piston has the second hollow portion and the first communication channels connected to the second hollow portion for leading discharged fluid from between the piston and the main body back inside the piston. The lower part can then be manufactured with a larger diameter thus creating more force to the impact.

The upper part of the piston may comprise one or more consecutive parts forming the upper part having the hollow portion, first communication hole and the annular pressurizing portion.

The lower part of the piston may comprise one or more consecutive parts forming the lower part having the second hollow portion and the first communication channels.

In this application relative terms such as "below", "upper" and "lower" refer to the hammer's normal using position on a flat surface. For example, "below" refers to a position closer to the drill bit.

Preferably, the hammer further includes a second space in the hollow interior of the main body between the piston and the main body in the radial direction of the piston and between the piston housing and the bit unit in the axial direction of the piston. The second space is used to lead discharged fluid outside the piston to lubricate the hammer and to flush out any debris inside the hammer.

The piston preferably further includes first communication channels from the second space into a second hollow portion of the piston located at the bit unit's end of the piston for discharging the fluid between the piston and the main body. In addition, the pressurized first space portion and the second space portion within the piston housing are relatively small in volume, decreasing the volume of pressurized operating fluid being transferred during percussive motion of the piston. The discharged fluid outside the piston may be used to fill the void between the piston and the drill bit created by the elevating piston so that fluid is not being sucked into the hammer from the bore hole. This decreases the amount of debris going inside the hammer during drilling, increasing the service life of the hammer. Even if some debris gets inside the hammer the discharged fluid flushes that debris out.

According to an embodiment of the invention the longitudinal length of the first space portion is 10-30%, preferably 20-25% of the length of the piston. Therefore, the second space below the piston housing is relatively large and not affected by the pressurized operating fluid, which means that a larger piston diameter may be used to increase the mass of the piston.

Preferably, hammer includes a piston seal between the piston housing and the upper part of the piston, which piston seal is a continuous circular seal. By detaching the lower part of the piston from the upper part, the continuous circular seal can be installed without stretching the seal extensively.

Preferably the piston has a first diameter and a second diameter over a length of the piston between the piston housing and the bit unit outside the partial length, the portion of the piston with the first diameter being in contact with the bit and being smaller in diameter than the second diameter. The larger diameter may be used between support points of the piston in order to increase the mass of the piston.

According to another embodiment, the lower part and the upper part of the piston may be connected to each other with threads. The threads connect the lower part and the upper part as a solid structure in the longitudinal direction of the piston. Threads stretch somewhat during tightening and form a tight locking between the parts.

According to an alternative embodiment the lower part and the upper part of the piston may be connected to each other with a lock pin. The lock pin connects the lower part and the upper part as a solid structure in the longitudinal direction of the piston.

Preferably, the first space portion for elevating the piston and the second space portion for striking the piston form piston reciprocating equipment which is located outside the length of the piston, which length is at the second end of the piston. By placing the piston reciprocating equipment in one place above the second end of the piston, the piston housing can also be quite short. This reduces the length of surfaces that need to be sealed against pressurized operating fluid.

According to an embodiment the piston has a second hollow portion for leading discharged fluid through the piston to the drill bit and out of the hammer and first communication channels formed to the piston connecting the second space to the second hollow portion for leading discharged fluid from between the piston and the main body back inside the piston to the second hollow portion. This means that the discharged fluid is lead through the piston which has a smaller head surface against the drill bit than full bodied pistons according to the prior art. This reduces the piston's tendency to create a vacuum while being elevated, which vacuum sucks debris from outside the hammer back inside of it.

The piston may include a male piston connection member and a female piston connection member of which one is a part of the lower part of the piston and the other is a part of the upper part of the piston. Connection members can be used to connect the upper part of the piston and the lower part of the piston to each other.

Preferably, the piston housing is a single uniform part. Therefore, the sealing between the piston housing and the piston is easier than when using a piston housing consisting of two or more separate parts which each need to be sealed.

According to an embodiment the lower part and the upper part of the piston are made of different materials. The parts may require different wear characteristics.

The axial direction of the first communication channels may be at an angle in relation to the second hollow portion, the angle being 30-60°, preferably 40-50°, relative to the longitudinal direction of the piston. This kind of design reduces the pressure losses of the fluid.

Preferably, the hammer further includes a piston bearing in connection with the bit unit for supporting the piston and second communication channels arranged in the piston bearing to provide discharged fluid between the piston and the drill bit, at least when the piston is elevated. The second communication channels provide an auxiliary passage for the discharged fluid to get between the piston and the drill bit in order to avoid the piston from sucking debris from outside the drill bit.

Preferably, the second space is excluded from the pressurized operating fluid and available only to discharged fluid. This enables the diameter of the lower part of the piston to be increased without losing effective surface area for the percussive motion of the piston.

Preferably, a majority of the mass of the piston is located on the length of the piston between the piston housing and the bit unit outside the partial length. Since the second space is available only to discharged fluid there is less resistance for movement of the heavier part of the piston.

Preferably, the drill bit includes shoulders or inserts arranged in the drill bit for impacting ground during drilling. This makes it possible to use the drilling device for efficiently drilling holes into rock mass.

Preferably, the hammer includes a bushing made of high strength metal, placed under the piston housing in the hammer's operating position for sealing the piston housing. The bushing may be used to replace any conventional seals between the piston and the piston housing. The bushing may be made of high strength metal, thus being very resistant to wear and also acting as a bearing between the piston and the piston housing.

The piston may be arranged to cooperate with the valve unit for indicating the axial position of the piston relative to the valve unit. This removes the need for using sensors to indicate the axial position of the piston relative to the valve unit.

Preferably, the hollow portion of the piston is discontinuous through the piston and the piston includes the hollow portion and the second hollow portion which are separated by a solid portion belonging to the piston. The pressurized operating fluid can then be led straight to the hollow portion inside the piston without increasing the speed of the fluid flow by guiding it to channels with a small diameter. Discharged fluid then flushes the main body's hollow interior effectively in order to flush out any debris from the hammer.

The second hollow portion has first communication channels for guiding the discharged fluid from the hollow interior of the main body back inside the piston to the second hollow portion.

The longitudinal length of the first space portion may be 10-30%, preferably 20-25% of the length of the piston. This means that the space between the piston housing and the piston is relatively small in volume so that fairly small amount of pressurized fluid is moved during percussive motion of the piston. The small size of the first space portion also forms the second space in the hollow interior of the main body below the piston housing and discharged fluid can be used to flush and lubricate this area.

Preferably the piston housing extends only over a partial length of the piston forming the second space in the hollow interior of the main body. Thus, the second space can be relatively large and the space inside the piston housing relatively small.

The diameter of the piston may be between 100-900 mm, preferably 140-300 mm. The length of the hammer may be 1.0-4.0 m, preferably 1.5-2.5 m. The length of the first space portion may be 100-600 mm, preferably 150-200 mm.

Preferably, the axial exhaust passage is located in the axial direction of the hammer between a lower end of the piston housing and lower end of the back head and in radial direction between piston housing and the main body. In this way the fluid can be discharged outside the piston housing so that outside the length of the piston housing discharged fluid flushes the hollow interior of the main body removing any debris inside the main body.

Preferably, diameter of the hollow portion of the piston is 80-120% of a diameter of the fluid pressure supply passage. This means that the flow speed of pressurized operating fluid entering the hammer will remain almost the same without major increase in speed as in prior art drilling devices wherein the fluid is led to a channel with much smaller diameter. Since the hollow portion is discontinuous the fluid flow will hit the bottom of the hollow portion which is not easily subjected to wear.

Preferably, diameter of the hollow portion is smaller than diameter of the valve exhaust passage and the diameter of the valve exhaust passage is smaller than diameter of axial exhaust passage in order to reduce back pressure created by the hammer. Fluid is always moving into a larger space which decreases the flow speed and reduces wear of the hammer.

Preferably, the hammer includes a piston upper hat having a second fluid pressure supply passage for guiding pressurized operating fluid into the hollow portion of the piston and a third fluid pressure passage for guiding pressurized operating fluid behind the valve unit into a chamber. Fluid guided to the third fluid pressure supply passages keeps the valve unit in its closed position before pressure in the second space portion is large enough to elevate the valve and enable fluid to be discharged through passage of the valve.

According to an embodiment the piston further includes a hydraulic braking shoulder for causing resistance for piston movement at an end of the piston's motion range in order to avoid piston damage. This also helps to dampen the movement of the piston.

The hammer may include a piston bearing hold for allowing fluid passage between the piston and the drill bit.

Preferably, the drill bit has a drill bit exhaust passage which is parallel to the direction of the axis of rotation of the drill rod. Therefore, the operating fluid can be discharged from the hammer straight through the second hollow portion of the lower part of the piston and the drill bit exhaust passage of the drill bit following it.

The invention is further characterized by a method for drilling a hole using a fluid operated drilling device, which method includes steps of pressurizing pressurized operating fluid with a fluid pressure supply unit, rotating a drill rod and a percussive hammer attached to the drill rod with a rotation device and leading pressurized operating fluid to a percussive hammer through the drill rod and straight from a back head to a hollow portion of the piston. The method further includes a step of using pressurized operating fluid in the percussive hammer to alternately elevate and impact a percussive piston by pressurizing a first space portion inside a piston housing to elevate the piston and a second space portion inside the piston housing to impact the piston to cause the percussive motion of a drill bit installed axially movably on the piston and discharging fluid from the first space portion and the second space portion outside the piston housing through an axial exhaust passage to flush and lubricate a hollow interior of the main body between the piston and a main body of the hammer outside the piston housing. In addition, the discharged fluid is guided back inside the piston from the hollow interior through first communication channels to a second hollow portion of the piston for leading the discharged fluid outside the hammer through the bit unit.

By guiding discharged fluid straight through the back head into the hollow portion of the piston, the speed of the fluid flow can be kept relatively constant. This reduces the wear of internal parts of the hammer when using abrasive fluids such as mud or oil. The fluid discharged outside the piston below the piston housing flushes any debris in the hollow interior of the main body of the hammer and the discharged fluid is led to fill the void formed between the drill bit and the piston when the piston is elevated. By discharging the fluid through the piston using the second hollow space, the suction effect of the piston created during elevation is reduced thus reducing debris sucked through the drill bit inside the hammer. The method facilitates keeping the inside of the hammer free of debris and therefore increases the service life of the hammer. It is another feature of the present invention that the pressure in the operating fluid's tank line is small compared to methods of the prior art.

According to an embodiment the operating fluid includes additives to increase the viscosity of operating fluid above viscosity of water. The abrasive effect of the operating fluid is increased when using operating fluids increasing the benefits of the method according to the invention wherein operating fluid is always led into a larger space therefore decreasing the speed of the operating fluid.

According a further embodiment, the operating fluid is oil. Wear of the hammer is a common problem related to oil drilling which can be alleviated with the method according to the invention.

According a another embodiment, operating fluid is mud. Wear of the hammer is also a common problem related to drilling with mud which can be alleviated with the method according to the invention.

According yet another embodiment, operating fluid has a viscosity of 0.01-20 Pas, preferably 0.05-3 Pas, in temperature of 20° C. Wear of the hammer is also a common problem related to drilling with any high viscosity fluid which can be alleviated with the method according to the invention.

Preferably, since fluid is relatively incompressible, the percussive hammer has the valve unit controlling the percussive motion. The percussive piston preferably cooperates with the valve unit indicating the valve unit axial position of the percussive piston.

Using the drilling device according to the invention it is easier to construct the valve unit from highly abrasion resistant materials thus making it possible to operate with high viscosity fluids containing a degree of abrasive particles such as drilling mud. With the help of one possible construction of the invention it is possible to manufacture a percussive fluid or a mud hammer equipped with a heavy percussive piston at a reasonable cost yet possible to incorporate special materials and material treatment due to an impact loading point, which strikes the percussive drill bit, that is not connected to the valve unit during its manufacturing process.

BRIEF DESCRIPTION OF THE DRAWINGS

The invention is described below in detail by referring to the appended drawings that illustrate some of the embodiments of the invention, in which.

Figure 1:
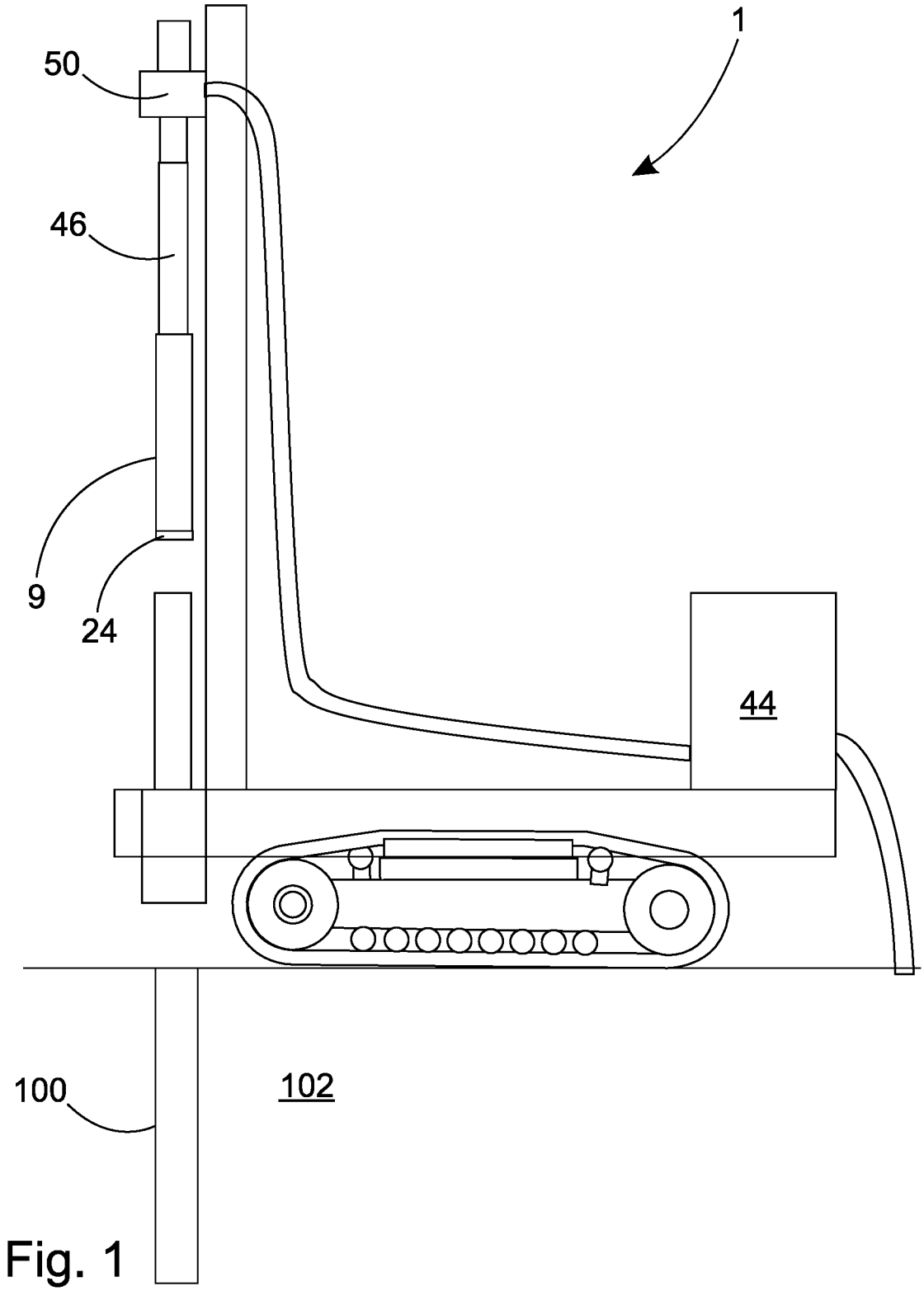
FIG. 1 is a side view of the drilling device according to a first embodiment of the invention.

In the drawings the following reference numbers are used to indicate features illustrated in the drawings

1 drilling device
9 percussive hammer
10 main body
12 hollow interior
14 back head
16 upper end of the main body
18 fluid pressure supply passage
20 piston housing
21 braking chamber
22 piston
23 second fluid pressure supply passage
24 drill bit
25 third fluid pressure supply passage
26 bit unit
28 lower end of the main body
30 hollow portion of the piston
32 annular pressurizing portion
33 valve exhaust passage
34 first communication hole
35 axial exhaust passage
36 piston's outer circumferential surface
37 second hollow portion of the piston
38 space
39 valve pressure passage
40 first space portion
42 second space portion
44 fluid pressure supply unit
46 drill rod
48 first communication channels
50 rotation device
52 second communication channels
54 drill bit nut
56 male piston connection member
58 female piston connection member
60 lower part of the piston
62 upper part of the piston
64 bearing hold
66 piston upper hat
68 adapter
70 valve housing
72 main chamber of the valve unit
74 hydraulic braking shoulder
76 valve unit
77 chamber
78 first end of the piston
79 second end of the piston
80 jacket pipe
82 lock pin
84 second space
86 piston guide bearing
88 drill bit exhaust passage
90 solid portion
92 third communication channel
94 piston reciprocating means
96 thread
98 piston seal
100 hole
102 ground

DETAILED DESCRIPTION OF THE INVENTION

According to FIG. 1, the drilling device 1 according to the invention includes as main parts a hammer 9 for creating a hole 100 in the ground 102, a fluid operated rotation device 50 for rotating the hammer 9 and a drill rod 46 connecting the rotation device 50 to the hammer 9. Fluid pressure may be used to lubricate parts of the hammer, flush the hole and flush out any debris from inside the hammer. The rotation device may be rotated by an electrical motor or it may also be fluid operated. An insertion pipe is normally led behind the drill rod inside the hole. In the drilling device 1 according to FIG. 1 the rotation device 50 rotates the drill rod 46, which then rotates the main body 10 of the hammer. The main body 10 then rotates the drill bit while a piston of the hammer causes a reciprocating movement of the drill bit 24.

Figure 2:
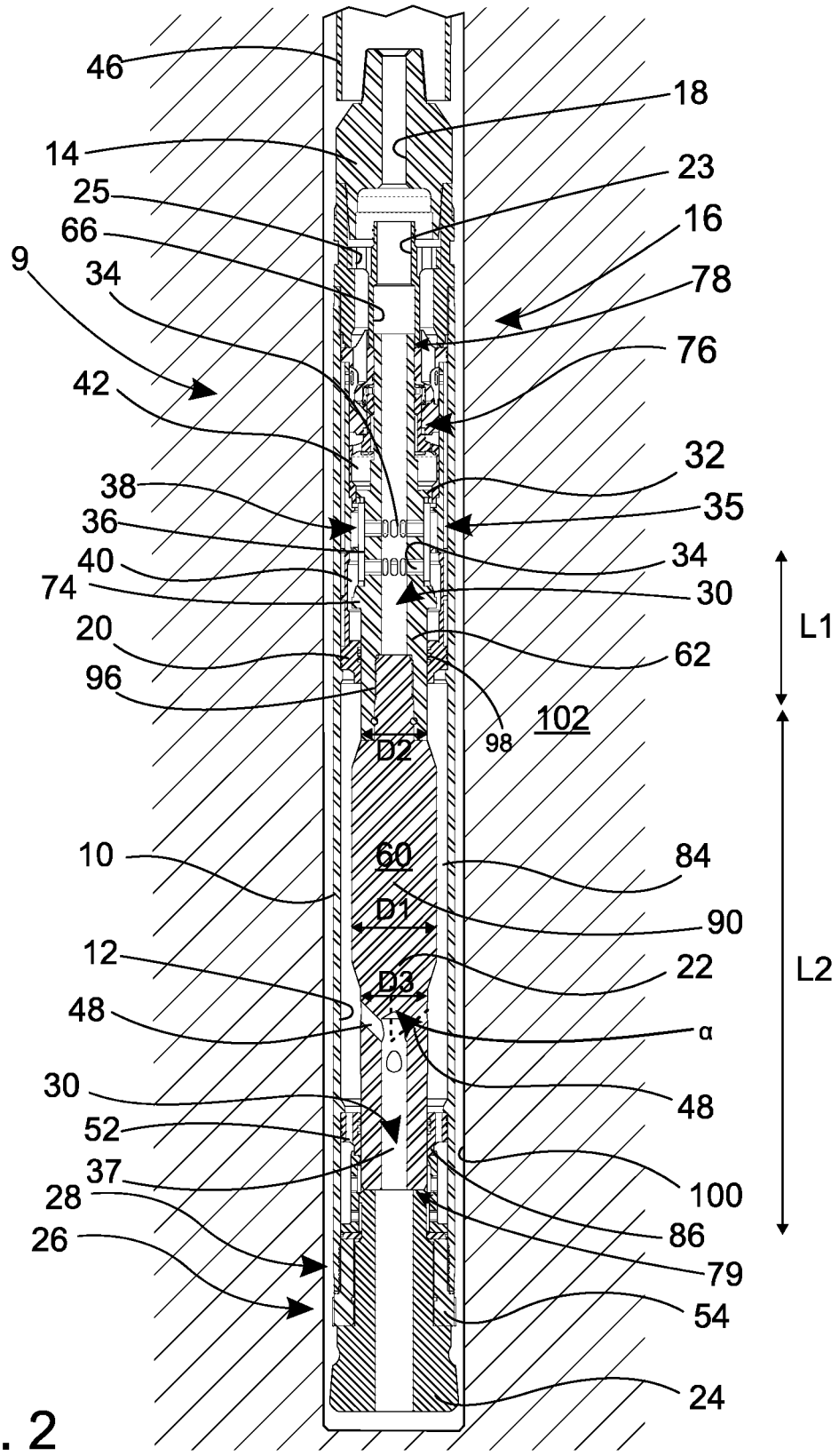
FIG. 2 is a cross-section of the hammer according to the first embodiment.

FIG. 2 illustrates an embodiment of the hammer 9 that can be used in the drilling device 1 according to the invention. The hammer 9 comprises a tubular main body 10 having a hollow interior 12, a back head 14 coupled to an upper end 16 of the main body 10 and having a fluid pressure supply passage 18 as well as a cylindrical piston housing 20 connected to the main body 10, preferably inside the main body 10. The fluid pressure supply passage 18 is arranged straight through the back head 14 to guide pressurized fluid flow straight through a piston upper hat 66 into a hollow portion 30 of the piston 22. In addition, the piston 22 is installed in the piston housing 20 for striking a drill bit 24 of a bit unit 26 installed at a lower end 28 of the main body 10. The piston 22 is preferably installed and supported slidably inside the piston housing 20. The piston 22 has a hollow portion 30, a first communication hole 34 connected to the hollow portion 30 and an annular pressurizing portion 32 protruding on piston's outer circumferential surface 36. The hollow portion 30 is not continuous axially through the piston 22 as in prior art hammers, but rather there are separate passages inside the piston, i.e. the hollow portion 30 and a second hollow portion 37. The hollow portion 30 is affected by the pressurized operating fluid whereas the second hollow portion 37 is affected by only discharged fluid.

In the hammer 9 there is a space 38 between the piston 22 and the piston housing 20 divided into first space portion 40 for elevating the piston 22 and second space portion 42 for striking the piston 22, along the length of the piston 22, the first space portions 40 and the second space portion 42 being preferably connected to the hollow portion 30 of the piston 22 via the first communication hole 34. In the embodiment disclosed in FIGS. 2-4*p* there are two first communication holes 34. The movement of the piston 22 and location of the annular pressurizing portion 32 in relation to the first space portion 40 and the second space portion 42 guides the elevation and impact motions of the piston 22.

The piston housing 20 preferably extends only over a partial length L1 of the piston 22. Axial exhaust passages 35 are arranged on the outer circumference of the piston housing 22 in order to discharge fluid from the second space portion 42. The piston 22 preferably further includes first communication channels 48 between the second hollow portion 37 of the piston 22 and the main body 10 on the first length L2 of the piston 22 between the piston housing 20 and the bit unit 26 outside partial length L1 leading the discharged fluid back inside the piston 22. The invention can be implemented also without these first communication channels. The axial direction of the first communication channels 48 may be at an angle α in relation to the axial direction of the piston 22, which angle is 30-60°, preferably 40-50°, in order to decrease pressure losses caused by the change of direction of the fluid flow.

Figure 3A:
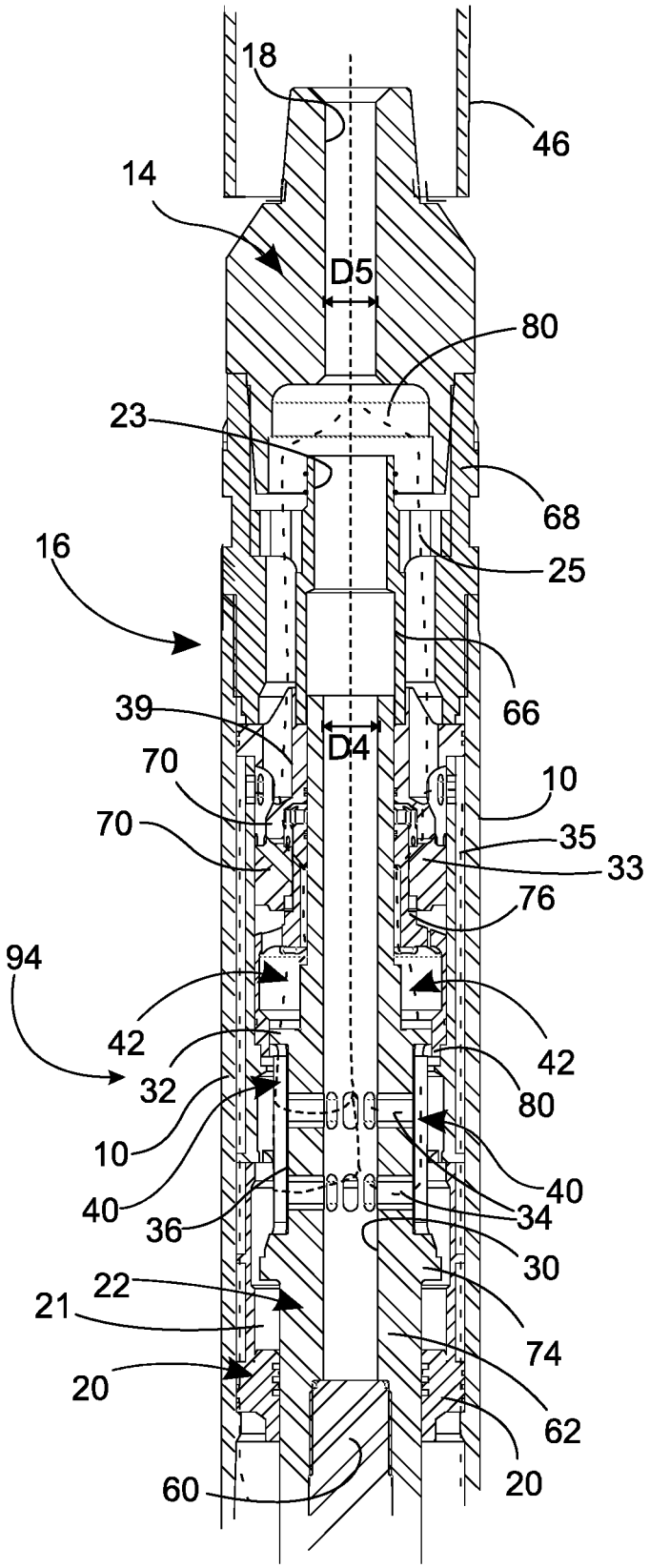
FIG. 3*a* is an enlargement of the lower end of hammer of FIG. 2.

The hammer also includes a valve unit 76 for discharging fluid from the second space portion 42 and a fluid pressure supply unit 44 for supplying pressurized operating fluid to the hollow portion 30 of the piston 22 and preferably also behind the valve unit 76. The pressurized operating fluid is delivered from the fluid pressure supply unit 44 through the drill rod 46, fluid pressure supply passage 18 of the back head 14 and through a second fluid pressure supply passage 23 of the piston upper hat 66 fitted at an end of the piston 22 straight to the hollow portion 30 of the piston 22. Alternatively, part of the pressurized operating fluid is led through a third fluid pressure supply passage 25 of the piston upper hat 66 to a chamber 77 behind the valve unit 76 and from that chamber 77 through a valve pressure passage 39 to a space behind the valve unit 76. In the embodiment of FIG. 3*a* the valve pressure passage 39 is formed differently. The valve unit may be a valve unit known from prior art. Preferably, fluid used in the drilling device and method according to the invention is fluid with high viscosity, most preferably oil or mud. Water may be used as well.

Piston 22 shown in FIG. 2, also known as a percussive piston, has in its upper part 62 at least part of the first space portion 40, which can also be called a lifting chamfer area, and at least part of the second space portion 42, which can also be called the striking area. The annular pressurizing portion 32, also known as a chamfer dividing area, is used to separate the first space portion 40 from the second space portion 42. The drilling device according to the invention may also incorporate a valve unit 76 elongating the annular pressurizing portion 32 shown in FIGS. 2, 3*a* and 4*a*-4*c*, or alternatively a pilot pressure controlling member connecting to a main valve unit controlling the main flow of the mentioned piston axially by means of effecting the mentioned first space portion and second space portion in order to create a percussive motion of said percussive piston. The piston 22 may include two consecutive parts, a lower part 60 having preferably the first communication channels 48 and the upper part 62 having the annular pressurizing portion 32.

In the invention the size of the first space portion or the second space portion is not limited as they can be elongated. The first space portion can be elongated towards the drill bit and the second space portion towards the main body. However, the annular pressurizing portion is located substantially at the top part of the piston at the piston's operation attitude.

Second diameter D2 in the middle section of the piston 22 makes it possible for the first space portion 40 to lift the piston 22 because the lifting diameter on the annular pressurizing portion 32 is larger than diameter D2, which diameter difference together with pressurized operating fluid causes a force that lifts the piston 22 up to its striking position. According to one embodiment shown in FIG. 2, the hammer 9 includes a hydraulic braking shoulder 74 which causes a braking effect for the piston 22 when the piston 22 is going forward during an impact motion and hydraulic braking shoulder 74 enters into the area of smaller diameter of the piston housing 20, i.e. braking chamber 21. The smaller diameter of the piston housing effectively reduces the power of the lifting force needed when hammer is lifted from its bottom position after the impact motion has ended. The hydraulic braking shoulder could also be situated in the piston in such way that the hydraulic braking shoulder would provide a braking effect also when elevating the piston thus avoiding any contact between the annular pressurizing portion and the valve unit.

The piston may also have a first diameter D1 which is preferably larger than second diameter D2. Since the piston 22 is supported only on the second diameter D2, the piston 22 may have a larger first diameter D1 increasing the mass of the piston and a third diameter D3 that may also be equal to or larger than second diameter D2. The hollow portion 30 of the piston 22 may have a diameter D4 which is 80-120% of a diameter D5 of the fluid pressure supply passage 18. This means that the speed of the fluid flow does not increase considerably or even decreases when pressurized operating fluid enters the hollow portion 30 of the piston 22. Although FIGS. 2-4*p* illustrate that the axial exhaust passage 35 is smaller than valve exhaust passage 33 and that valve exhaust passage 33 is smaller than diameter of the hollow portion 30, it should be understood that preferably the diameter of the hollow portion 30 is smaller than diameter of the valve exhaust passage 33 and the diameter of the valve exhaust passage 33 is smaller than diameter of axial exhaust passage 35 in order to reduce back pressure created by the hammer 9.

Figure 3B:
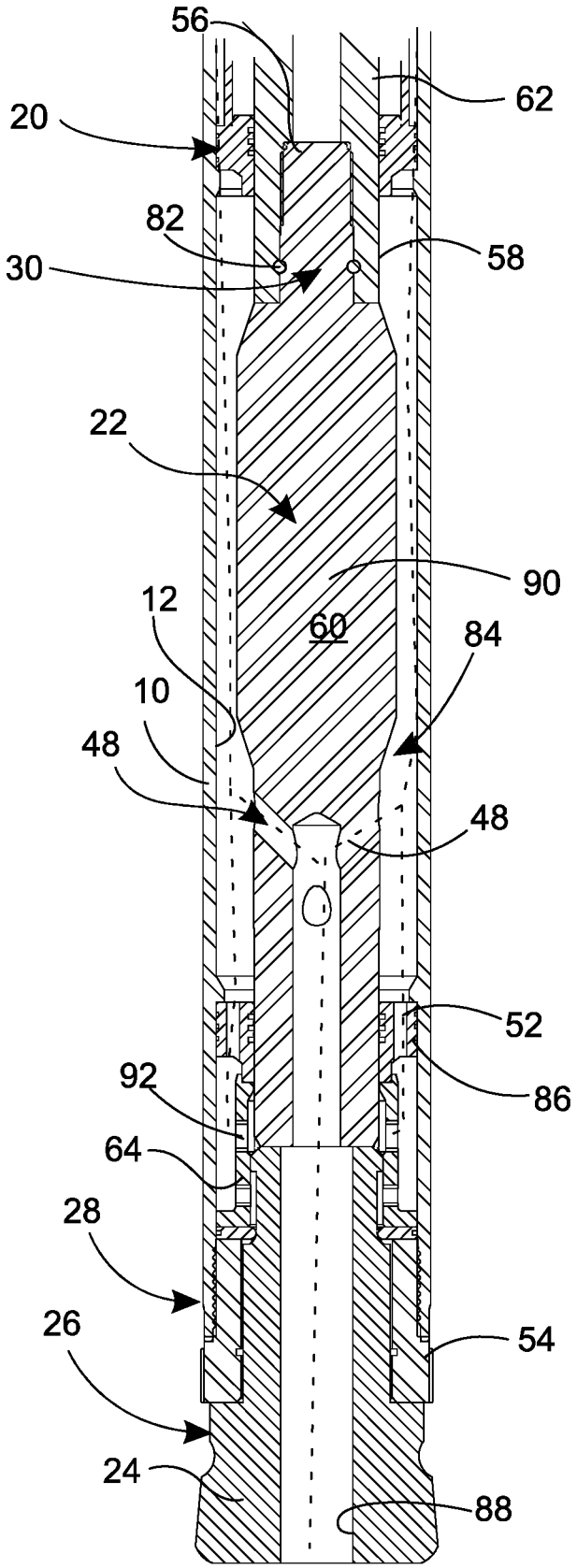
FIG. 3*b* is an enlargement of the upper end of hammer of FIG. 2, FIGS. 4*a*-4*p* are cross-section views of the hammer according to the first embodiment in different stages of drilling.

The percussive piston 22 is configured to strike the percussive drill bit 24 of the drill bit unit 26 shown in FIGS. 3*a* and 3*b*. The drill bit unit 26 is attached to the main body 10 of the hammer 9 which is then connected to the drill rod 46 using a back head 14 attached to the hammer 9. The flow of the pressurized fluid is led through the drill rod 46 via the fluid pressure supply passage 18 of the back head 14 inside the hammer 9 to create the pressure of fluid to effect the percussive motion of the percussive piston 22 against percussive drill bit 24. As shown in FIGS. 2-4*c* the piston 22 comprises the lower part 60 assembled to transmit the percussive force to the drill bit 24 and upper part 62 assembled to effect reciprocating action of the percussive piston 22.

The first space portion 40, also known as the lifting chamfer, inside the piston housing 20 is limited by piston housing 20 which is sealing and centralizing the piston 22. The piston housing 20 effectively limits the first space portion 40 towards the drill bit 24. The piston housing may include a second piston bearing as well as a sealing portion. Fluid is discharged through a valve exhaust passage 33 located in the valve unit 76 and then led to axial exhaust passages 35 located radially outside the piston housing 20. Discharged fluid passing the axial exhaust passage 35 is then led to the outside diameter of the piston 22, i.e. into a second space 84 in the hollow interior 12 of the main body 10. According to one preferred embodiment, part of the discharged fluid is transferred at least partially back inside piston 22 to the second hollow portion 37 or at least partially through a second communication channel 52 of the piston guide bearing 86, also known as the piston centralizing element. When piston 22 is elevated backwards after an impact motion, discharged fluid fills up the void created by the lifting piston 22 by leading fluid through the second hollow portion 37 as well as through the second communication channels 52 reducing the suction effect of the large piston 22. The second communication channels are not a compulsory part of the hammer but a preferable feature.

In the present invention the pressurized area containing the pressurized operating fluid is only between the piston housing 20 and the valve housing 70 shown in FIG. 3*a* in the longitudinal direction of the piston 22 as well as in the hollow portion 30 of the piston 22. This makes it possible to use large piston diameters below the piston housing even almost as large as the main body's inner diameter if the piston is grooved in its axial direction. The impact force created by the piston is defined by the relation between the diameter of the piston inside the piston housing and the diameter of the piston at the annular pressurizing portion. The hollow portion 30 of the piston 22 is not continuous through the piston 22 from upper end of the piston 22 to the lower end but divided into two separate parts, i.e. the hollow portion 30 and the second hollow portion 37, by a solid portion 90.

Figure 4A:
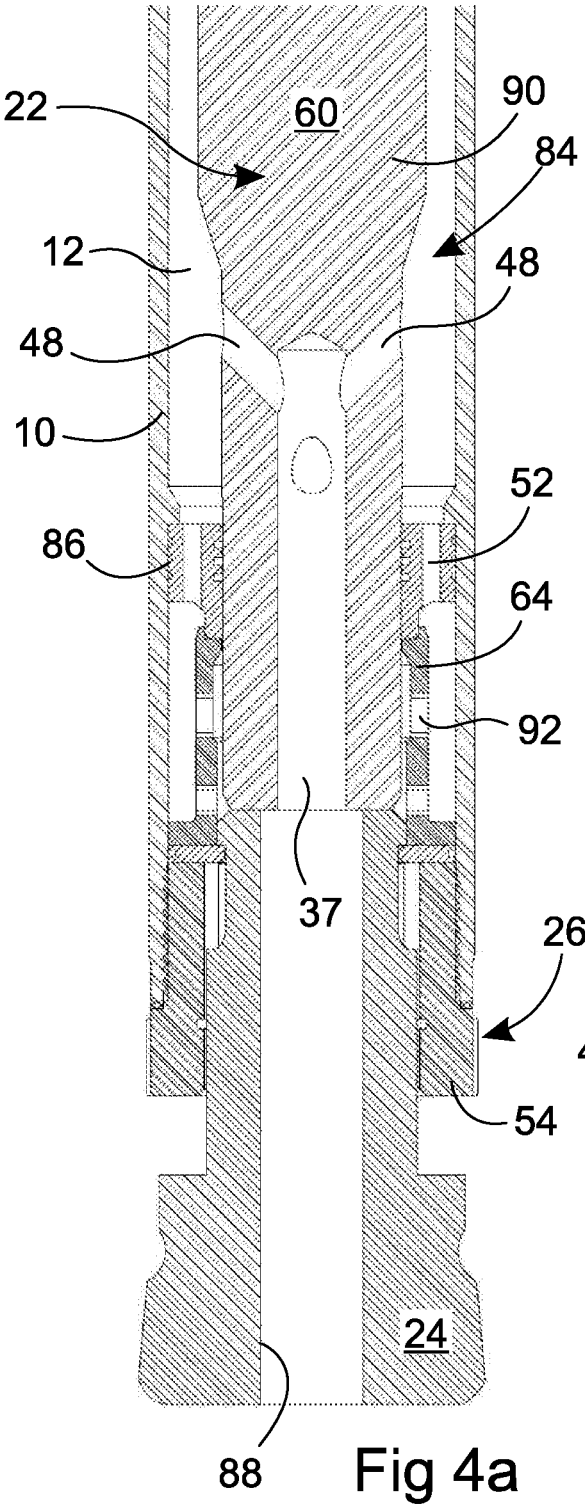
Figure 4B:
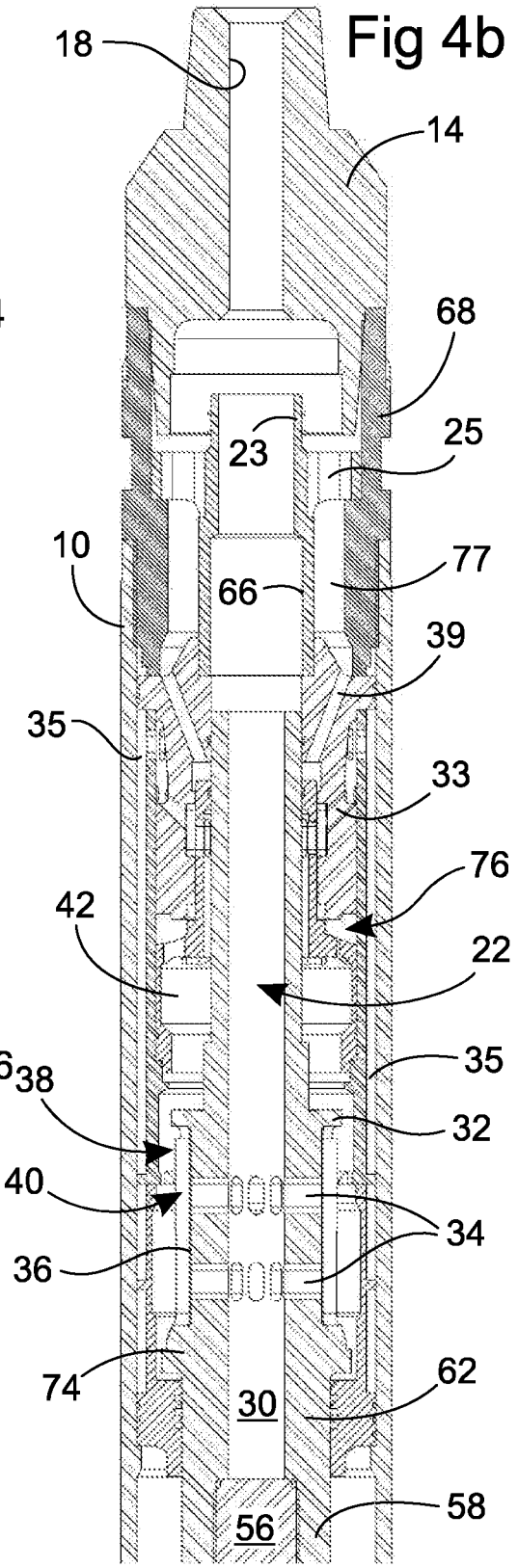
Figure 4E:
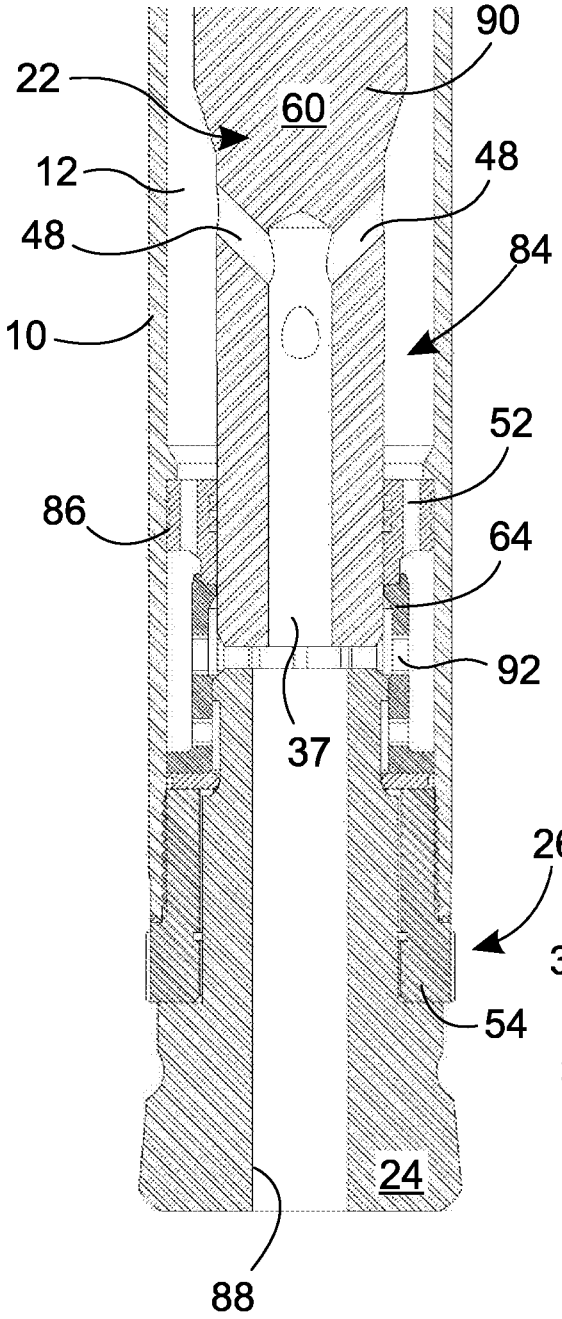
Figure 4F:
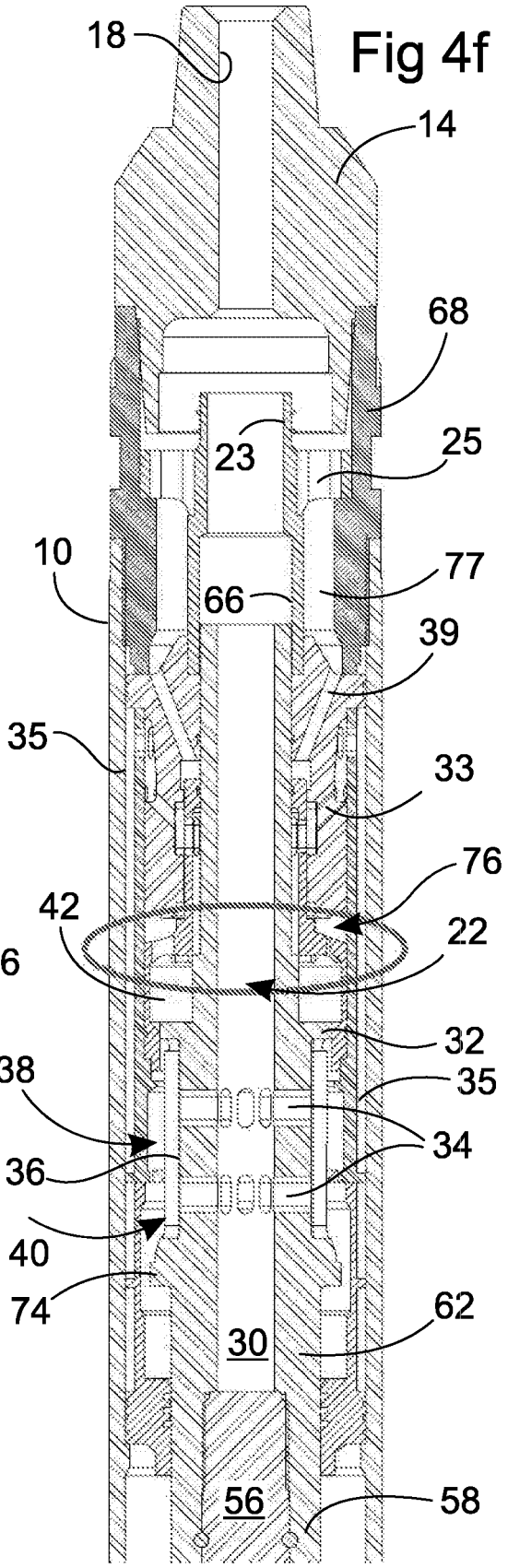
Figure 4G:
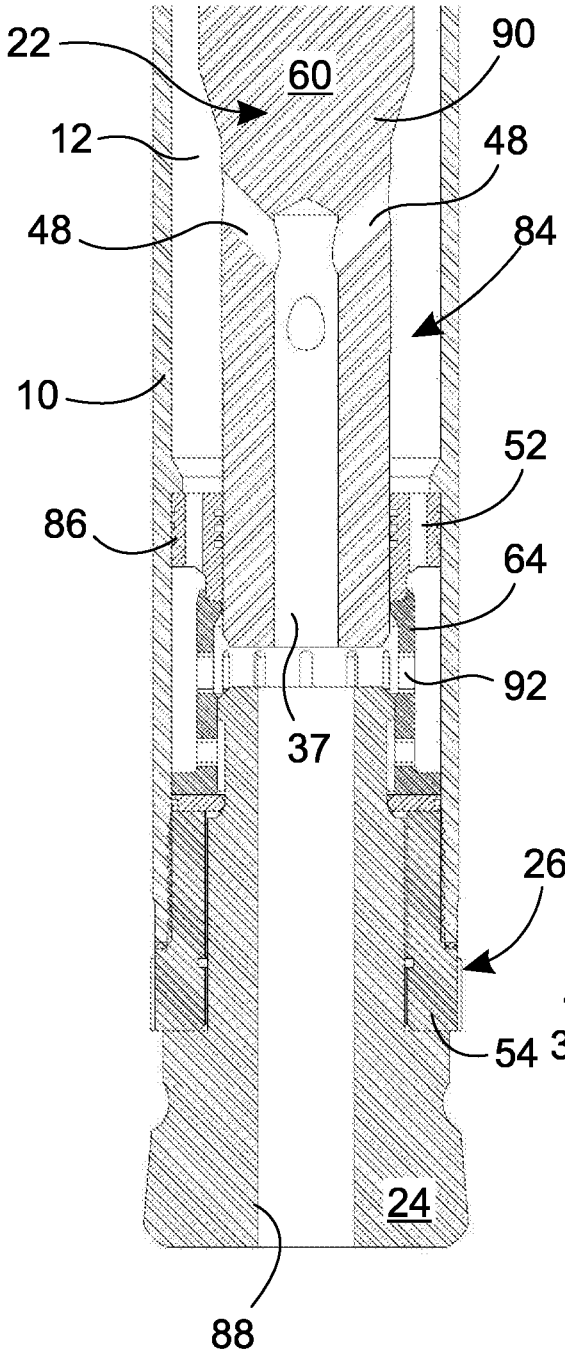
Figure 4H:
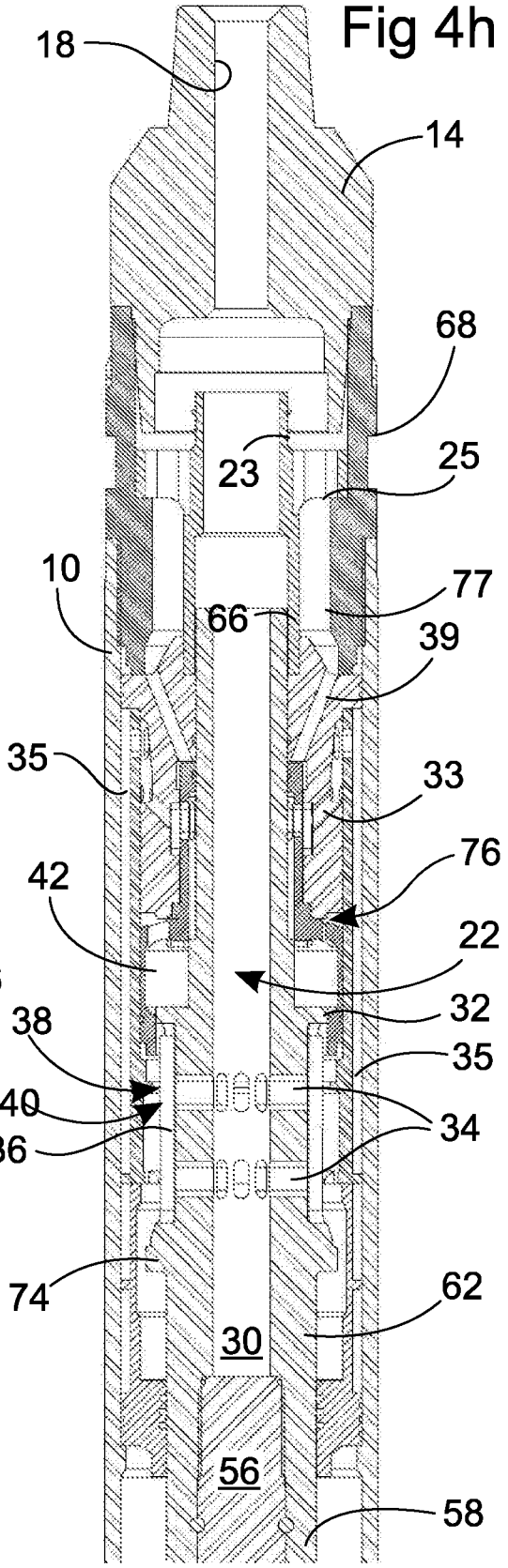
Figure 4I:
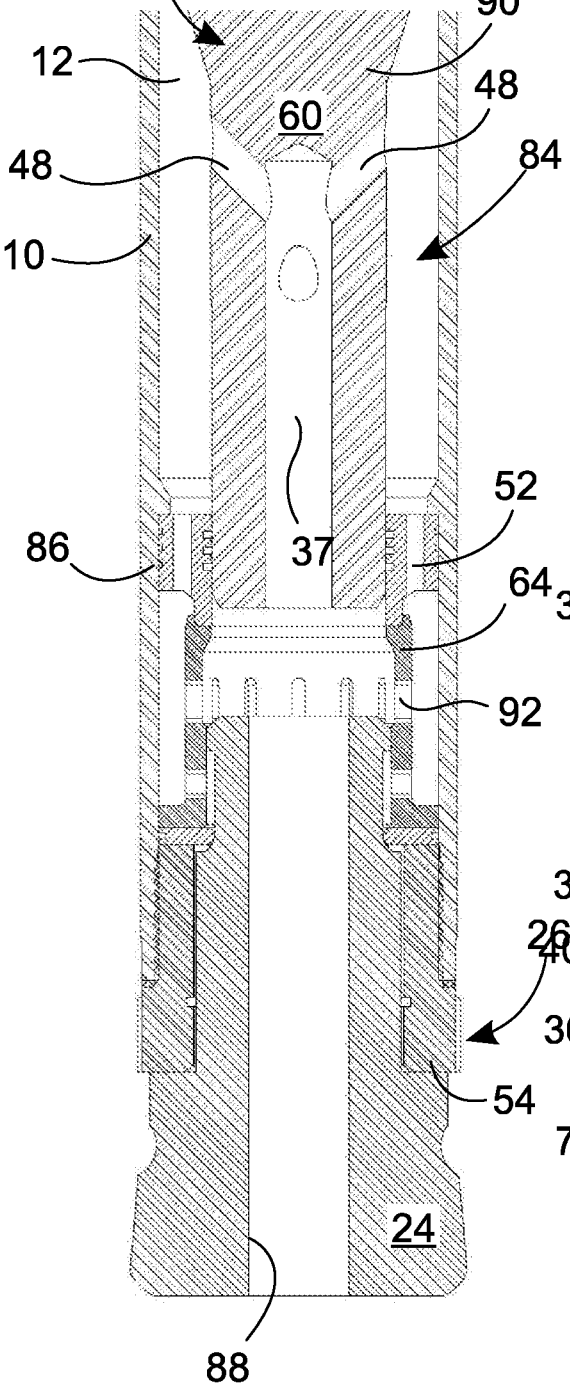
Figure 4J:
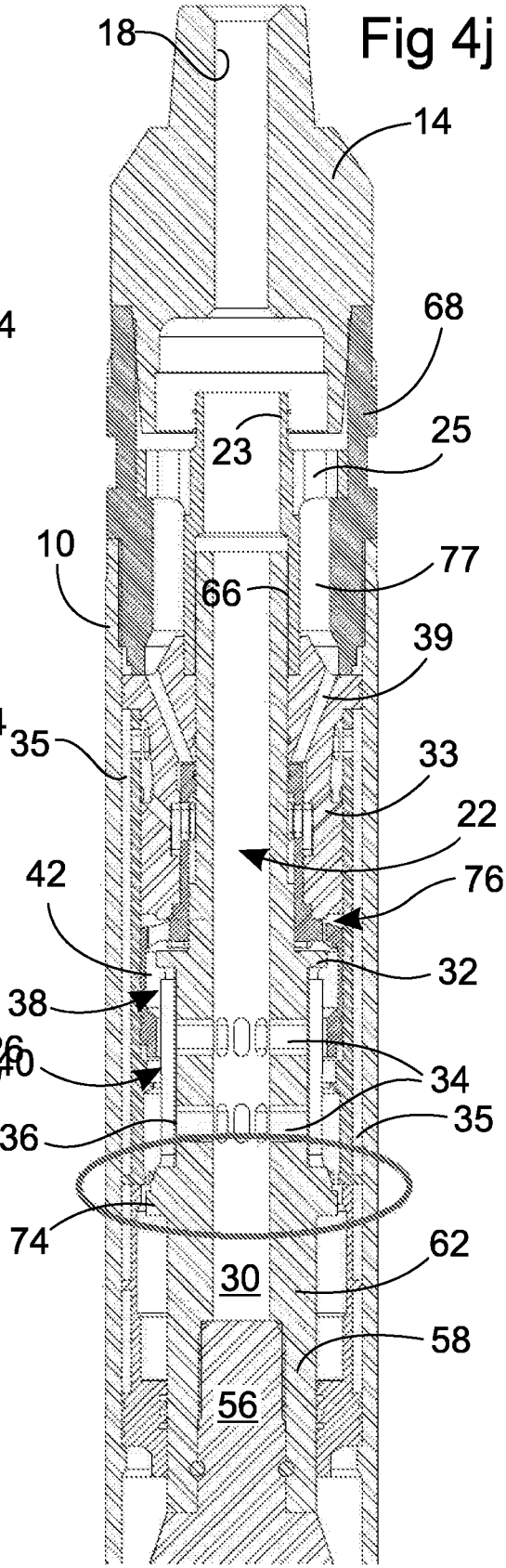
Figure 4M:
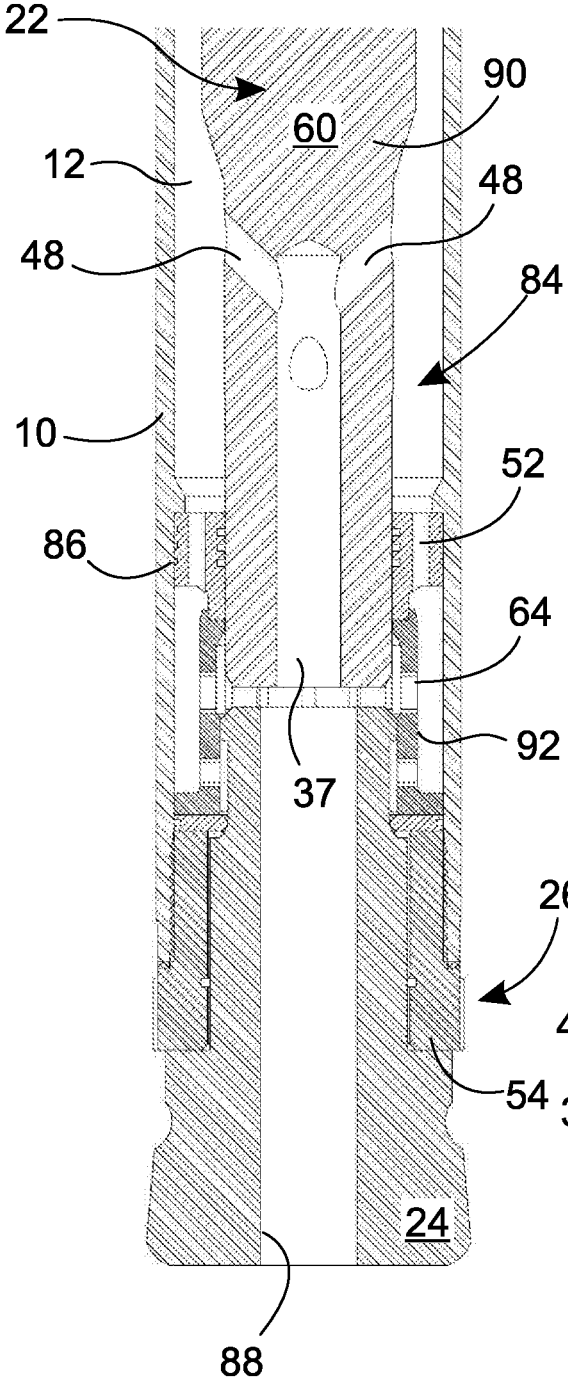
Figure 4N:
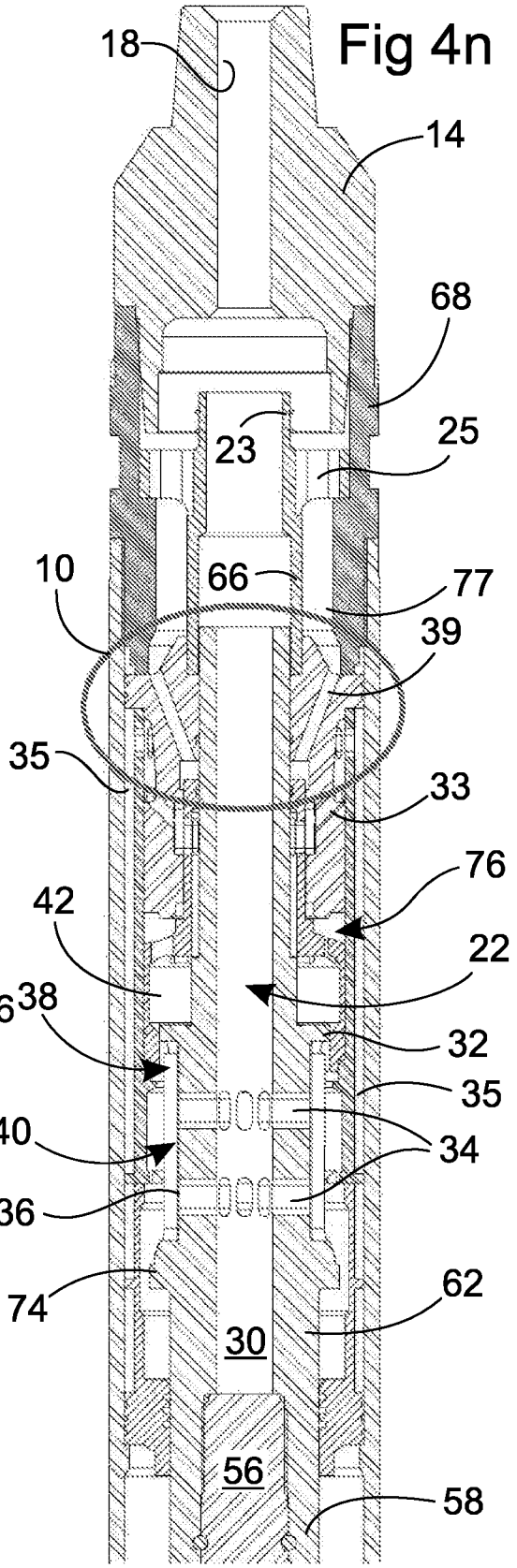
Figure 4O:
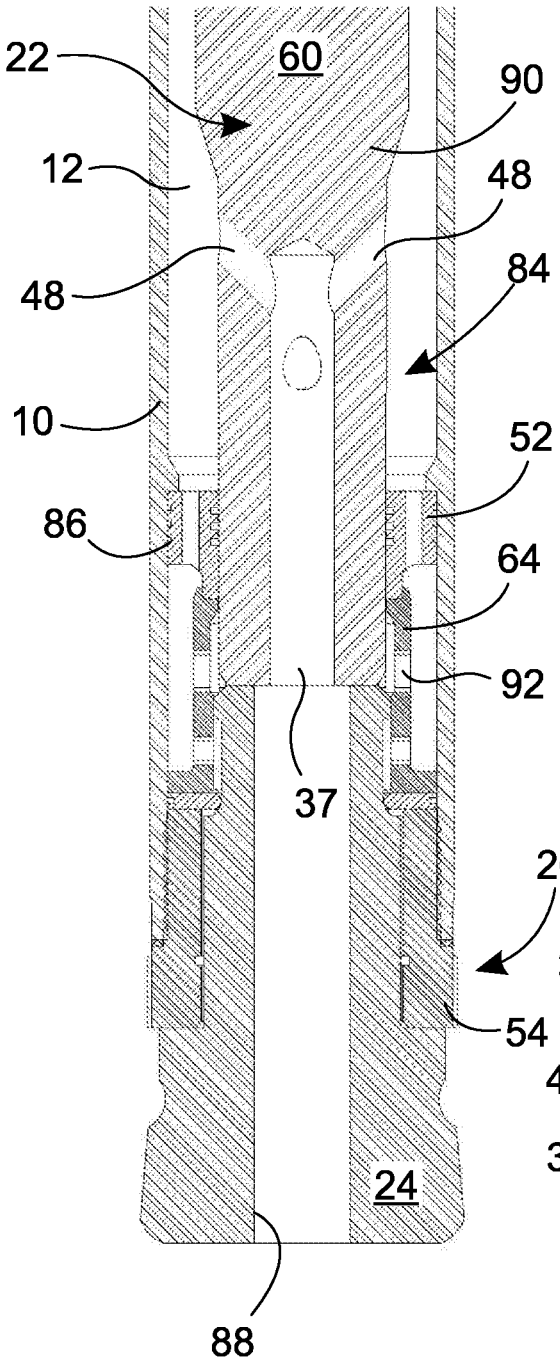
Figure 4P:
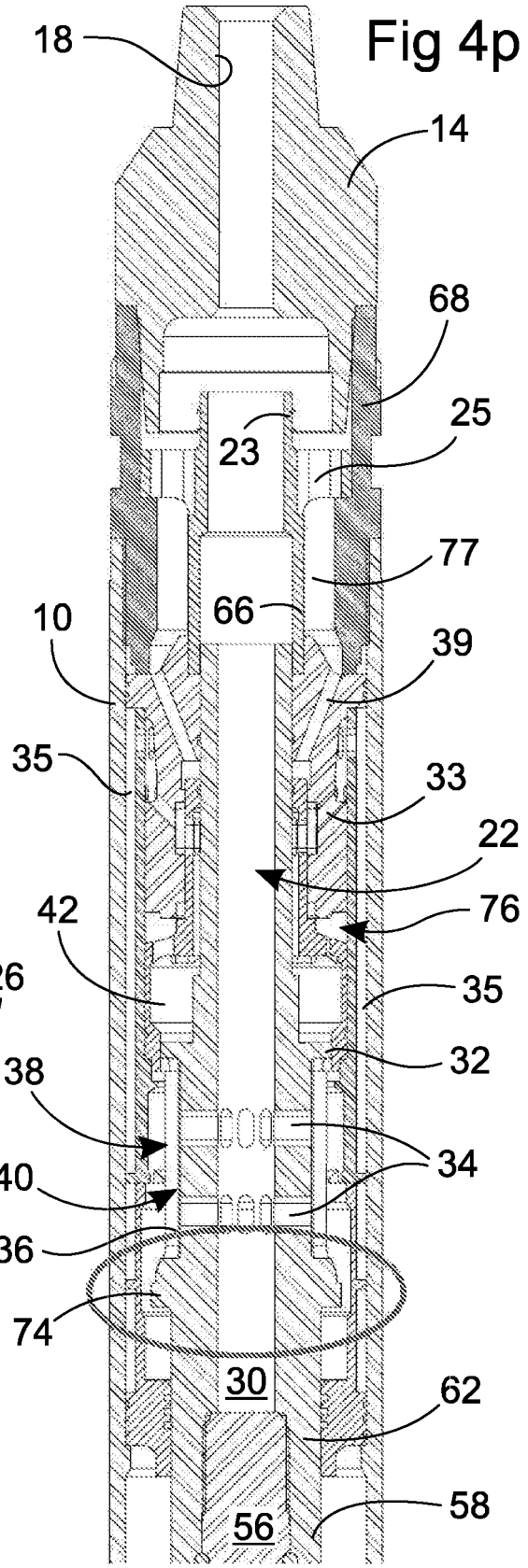
Figure 5A:
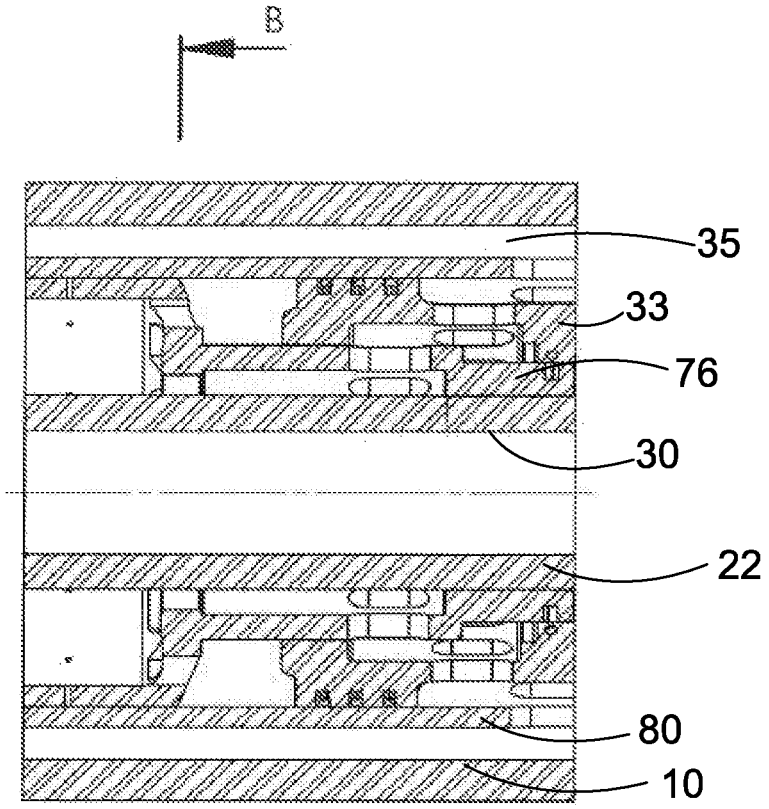
FIG. 5*a* is an enlargement of a second embodiment taken from location of the hammer indicated by the section B-B of FIG. 4*d*.
Figure 5B:
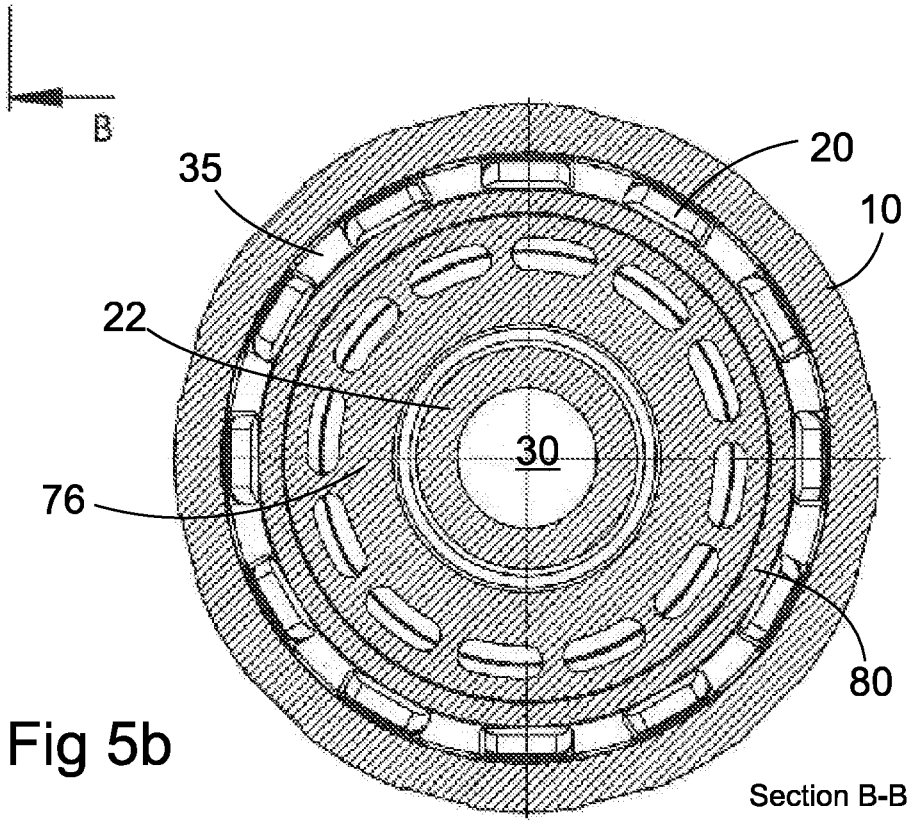
FIG. 5*b* is a cross-section of section B-B of the second embodiment shown in FIG. 5*a*.
Figure 6A:
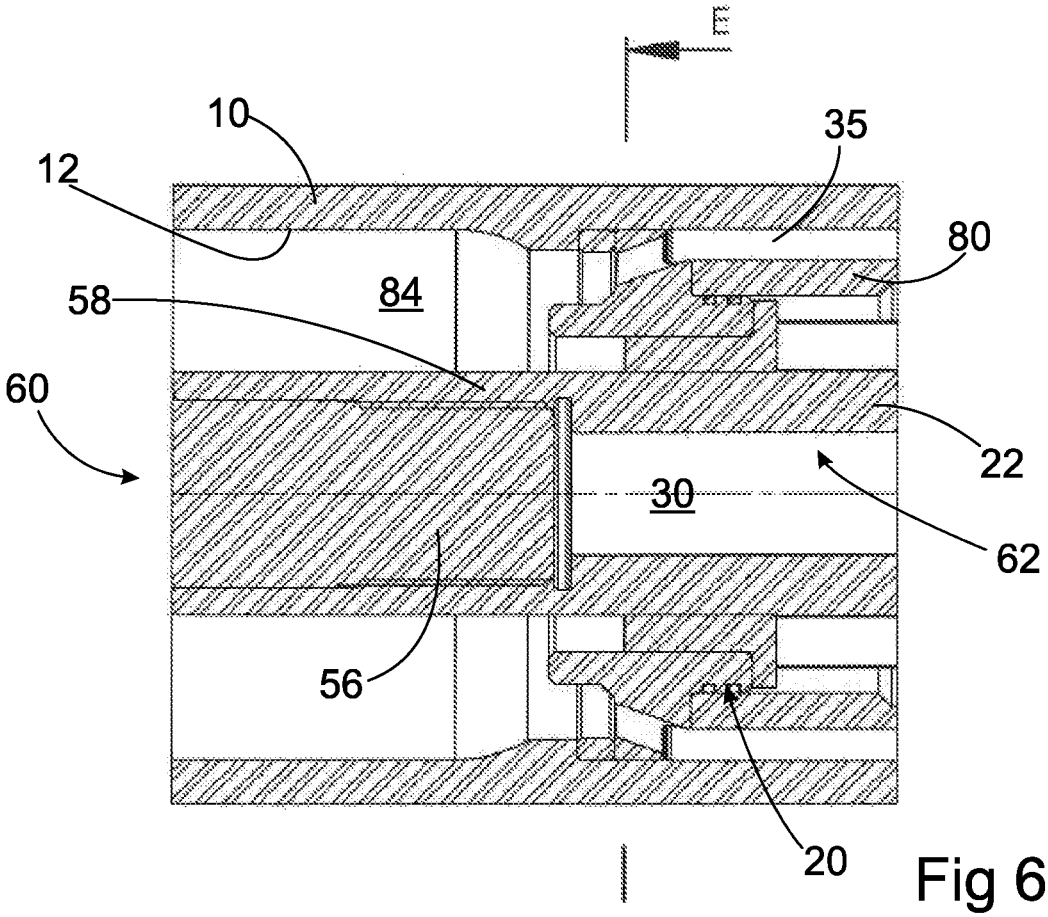
FIG. 6*a* is an enlargement of a second embodiment taken from a location of the hammer indicated by the section E-E of FIG. 4*d*.
Figure 6B:
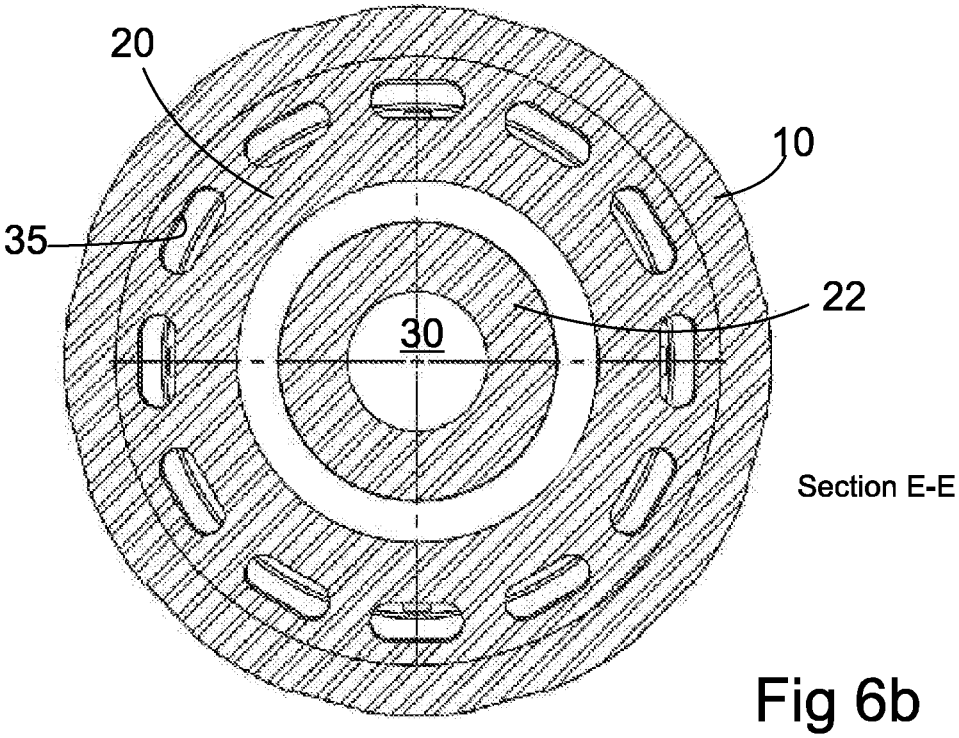
FIG. 6*b* is a cross-section of section E-E of the second embodiment shown in FIG. 6*a*.

The flow path of fluid is disclosed in FIGS. 3*a* and 3*b* with dotted lines whereas FIGS. 4*a*-4*p* show different stages of percussive motion of the hammer. In FIG. 4*a* the hammer 9 is with the drill bit 24 in hang position. In this position, there is no resultant flow to drive the piston 22 of FIG. 4*b* upwards, therefore no movement of the piston 22. According to FIG. 4*c* the drill bit 24 makes contact with the deface to be drilled and moves upwards. In turn, the piston 22 shown in FIG. 4*d* also moves upwards and the annular pressurizing portion 32 of the piston 22 moves into the valve unit 76 in the circled area. Fluid flows down the fluid pressure supply passage 18 of the back head 14 and the second fluid pressure supply passage 23 of the piston upper hat 66 and then to the hollow portion 30 of the piston 22. This fluid flows out of the first communication holes 34 in the piston 22 and fills the first space portion 40. Now there is a build-up of pressure behind the annular pressurizing portion 32 in the first space portion 40. On the other side of the annular pressurizing portion 32, inside the second space portion 42, fluid is free to flow through the valve exhaust passage 33 to the axial exhaust passage 35. This pressure differential leads the piston 22 starting to be driven upwards against the force of gravity. There is also a residual flow of fluid flowing through the third fluid pressure supply passages 25 of the piston upper hat 66 towards the valve unit 76 via chamber 77 and valve pressure passage 39. This flow helps to keep the valve unit 76 in the closed position, aided by gravity.

In FIGS. 4*e* and 4*f* the piston 22 moves upwards and away from the drill bit 24. The shoulder 75 of piston 22 starts to move into the smaller bore of the valve unit 76 in the area circled, preventing fluid within the second space portion 42 being able to flow through to valve exhaust passage 33. Now fluid within the second space portion 42 has nowhere to go, leading to a build-up of pressure. In FIGS. 4*g* and 4*h* the combination of this pressure build-up within the valve unit 76 and in the second space portion 42 forces the valve unit 76 to move upwards with the piston 22 against the force of gravity. In FIGS. 4*i* and 4*j* the upward momentum of the piston 22 allows the annular pressurizing portion 32 to pass through into the second space portion 42. This in turn, along with gravity, relieves the pressure inside the second space portion 42 and the piston 22 starts to decelerate. Also, the hydraulic braking shoulder 74 at the first space portion 40 passes into the smaller bore of the piston housing 20, as shown where circled, reducing the pressure below this and creating a greater pressure differential at the top end. This starts to drive the piston 22 downwards, accompanied by the gravitational force acting on it.

In FIGS. 4*k* and 4*l* the piston 22 moves downwards towards the drill bit 24. The annular pressurizing portion 32 of the piston 22 moves back into the circled area of the valve unit 76. The downward momentum of the piston 22 brings the annular pressurizing portion 32 of the piston 22 outside the smaller bore of the valve unit 76, which allows any fluid in the second space portion 42 to flow to valve exhaust passage 33. In FIGS. 4*m* and 4*n* the piston 22 continues to move downwards towards the drill bit 24. Due to fluid in the second space portion 42 now being able to flow to the valve exhaust passage 33, the valve unit 76 moves downwards along with the piston 22 and aided by gravity. The valve exhaust passage 33 and the third fluid pressure passage 25 allow fluid to flow into a chamber 77 above the valve unit 76, helping the valve unit 76 to drop back down. In FIGS. 4*o* and 4*p* the hydraulic braking shoulder 74 moves close to small diameter in circled area in the first space portion 40 inside the piston housing 20. This movement has a cushioning effect and decelerates the piston 22. Downward motion of piston 22 continues through its momentum and gravitational pull and strikes the drill bit 24.

The cycle of the percussive motion repeats from the stage wherein the piston is in contact with the drill bit onwards until the hammer is withdrawn, and then the drill bit goes down back into its hang position, resulting in the fluid freely flowing to through the first communication hole into the hollow portion of the piston, stopping the shuttling action.

The invention claimed is:

1. A fluid operated drilling device for drilling a hole, the drilling device comprising:

- a hammer for creating the hole with a rotating and percussive motion;
- a rotation device for rotating the hammer; and
- a drill rod connecting the rotation device to the hammer and transporting pressurized operating fluid to the hammer for creating the percussive motion of the hammer, wherein the hammer comprises:
  - a tubular main body having a hollow interior;
  - a back head, for connecting the hammer to the drill rod, coupled to an upper end of the main body and having a fluid pressure supply passage;
  - a cylindrical piston housing connected to the main body inside the main body;
  - a reciprocating piston slidably installed in the piston housing, for impacting a drill bit of a bit unit installed at a lower end of the main body, the drill bit being movable for a predetermined length longitudinally relative to the main body, the piston having: a first end and a second end, the first end being closer to the drill rod, a lower part and an upper part detachably connected to each other, a hollow portion, a first communication hole connected to the hollow portion and an annular pressurizing portion protruding on an outer circumferential surface of the piston, the hollow portion being open to lead pressurized operating fluid directly to the hollow portion of the piston from the fluid pressure supply passage;
  - a space between the piston and the piston housing divided by the annular pressurizing portion in a radial direction of the piston into a first space portion for elevating the piston and a second space portion for pressurized operating fluid when striking the piston, the first space portion and the second space portion being connected to the hollow portion of the piston via the first communication hole;
  - a second space in the hollow interior of the main body between the piston and the main body in the radial direction of the piston and between the piston housing and the bit unit in the axial direction of the piston;

a second hollow portion in the piston for leading discharged fluid through the piston to the drill bit and out of the hammer;

first communication channels formed in the piston connecting the second space to the second hollow portion for leading discharged fluid from between the piston and the main body back inside the piston to the second hollow portion;

a valve unit for controlling fluid discharge from the second space portion, the valve unit including a valve exhaust passage for discharging fluid from the second space portion;

a fluid pressure supply unit for supplying high pressure fluid delivered to the fluid pressure supply passage of the back head to the first space portion and the second space portion; and an axial exhaust passage formed between the main body and the piston housing for discharging fluid outside the piston housing;

wherein the fluid discharged from the second space portion is led through the valve exhaust passage and the axial exhaust passage, and the rotation device rotates the bit unit using the drill rod and the main body.

2. The drilling device according to claim 1, wherein the piston has at least a first diameter over a first length of the piston between the piston housing and the bit unit outside a partial length of the piston housing and a second diameter over the partial length of the housing for limiting the space, wherein a portion of the piston with the first diameter is larger in diameter than the second diameter.

3. The drilling device according to claim 2, wherein the first space portion for elevating the piston and second space portion for pressurized operating fluid when striking the piston form piston reciprocating equipment which are located outside the first length of the piston, which first length is at the second end of the piston.

4. The drilling device according to claim 2, wherein a diameter of the hollow portion is smaller than a diameter of the valve exhaust passage and the diameter of the valve exhaust passage is smaller than a diameter of the axial exhaust passage in order to reduce back pressure created by the hammer.

5. The drilling device according to claim 1, wherein the piston comprises a male piston connection member and a female piston connection member of which one is a part of the lower part of the piston and other is a part of the upper part of the piston.

6. The drilling device according to claim 1, wherein the upper part of the piston comprises the hollow portion, the first communication hole and the annular pressurizing portion, and the lower part comprises the second hollow portion and the first communication channels.

7. The drilling device according to claim 1, wherein the piston housing is a single uniform part.

8. The drilling device according to claim 1, wherein the lower part and the upper part of the piston are made of different materials.

9. The drilling device according to claim 1, wherein the hammer comprises a piston guide bearing in connection with the bit unit for supporting the piston, and second communication channels arranged in the piston guide bearing to provide discharged fluid between the piston and the drill bit at least when the piston is elevated.

10. The drilling device according to claim 1, wherein the hollow portion and the second hollow portion are separated from each other by a solid portion belonging to the piston.

11. The drilling device according to claim 1, wherein the axial exhaust passage is located in the axial direction of the hammer between a lower end of the piston housing and lower end of the back head and in a radial direction between the piston housing and the main body.

12. The drilling device according to claim 1, wherein a diameter of the hollow portion of the piston is 80-120% of a diameter of the fluid pressure supply passage.

13. The drilling device according to claim 1, wherein the hammer comprises a piston upper hat having a second fluid pressure supply passage for guiding pressurized operating fluid into the hollow portion of the piston and a third fluid pressure passage for guiding pressurized operating fluid behind the valve unit into a chamber.

14. The drilling device according to claim 1, wherein the hammer comprises a piston seal between the piston housing and the upper part of the piston, which piston seal is a continuous circular seal.

15. The drilling device according to claim 1, wherein the drill bit comprises a drill bit exhaust passage which is parallel to a direction of the axis of rotation of the drill rod.

16. A method for drilling a hole using a fluid operated drilling device, the method comprising steps of:

pressurizing operating fluid with a fluid pressure supply unit to produce pressurized operating fluid;

rotating a drill rod and a percussive hammer attached to the drill rod with a rotation device;

leading the pressurized operating fluid to a percussive hammer through the drill rod;

guiding the pressurized operating fluid from a back head through a fluid pressure supply passage directly to a hollow portion of the piston;

using the pressurized operating fluid in the percussive hammer to alternately elevate and impact a percussive piston by pressurizing a first space portion inside a piston housing to elevate the piston and a second space portion inside the piston housing to impact the piston to cause the percussive motion of a drill bit installed axially movably on the piston, the piston having a lower part and an upper part detachably connected to each other;

discharging fluid from the first space portion and the second space portion outside the piston housing through a valve exhaust passage and an axial exhaust passage to flush and lubricate a hollow interior of a main body between the piston and the main body of the hammer outside the piston housing; and guiding the discharged fluid back inside the piston from the hollow interior through first communication channels to a second hollow portion of the piston for leading the discharged fluid outside the hammer through the bit unit.

17. The method according to claim 16, wherein said operating fluid includes additives to increase the viscosity of operating fluid above viscosity of water.

18. The method according to claim 16, wherein said operating fluid is oil or mud.

19. The method according to claim 16, wherein the operating fluid has a viscosity of 0.01-20 Pas at a temperature of 20° C.

* * * * *